US005298374A

United States Patent [19]

Tomiyama et al.

[11] Patent Number: 5,298,374

[45] Date of Patent: * Mar. 29, 1994

[54] SILVER HALIDE COLOR PHOTOGRAPHIC MATERIAL

[75] Inventors: Hideki Tomiyama; Akira Kase, both of Minami-ashigara, Japan

[73] Assignee: Fuji Photo Film Co., Ltd., Kanagawa, Japan

[ * ] Notice: The portion of the term of this patent subsequent to Apr. 6, 2010 has been disclaimed.

[21] Appl. No.: 747,669

[22] Filed: Aug. 20, 1991

[30] Foreign Application Priority Data

Aug. 20, 1990 [JP] Japan ..... 2-218597
Sep. 26, 1990 [JP] Japan ..... 2-256087

[51] Int. Cl.[5] ..... G03C 1/46

[52] U.S. Cl. ..... 430/502; 430/546; 430/551; 430/607; 430/553; 430/557

[58] Field of Search ..... 430/551, 546, 607, 545, 430/557, 553, 567, 502

[56] References Cited

U.S. PATENT DOCUMENTS

| | | | |
|---|---|---|---|
| 3,679,630 | 7/1972 | Corson | 528/21 |
| 3,782,952 | 1/1974 | Monsey et al. | 220/334 |
| 4,540,657 | 9/1985 | Krishnamurthy | 430/546 |
| 4,857,444 | 8/1989 | Hirose et al. | 430/549 |
| 4,902,600 | 2/1990 | Tamagawa et al. | 430/138 |
| 5,001,045 | 3/1991 | Furutachi et al. | 430/545 |
| 5,200,307 | 4/1993 | Takahashi | 430/507 |

FOREIGN PATENT DOCUMENTS

| | | |
|---|---|---|
| 0183444 | 6/1986 | European Pat. Off. . |
| 0304067 | 2/1989 | European Pat. Off. . |
| 0368271 | 5/1990 | European Pat. Off. . |
| 60-96618 | 5/1985 | Japan . |
| 1-172417 | 7/1989 | Japan . |
| 3-8638 | 2/1991 | Japan . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

There is disclosed a silver halide color photographic material which comprises a hydrophilic colloid layer, on a paper base, containing a compound selected from the group consisting of sparingly water-soluble epoxy compounds represented by formula (I), (II), or (III) given below and a dye-forming coupler in a layer on a base wherein the pH of raw paper is 5 to 9.

Formula (I)

Formula (II)

Formula (III)

wherein $R^1$, $R^2$, and $R^3$ each represent an alkyl group or a halogen atom, $L^1$ and $L^2$ each represent a divalent aliphatic organic group, M represents an oxygen or nitrogen atom, A represents a polyvalent linking group, a, b, and c each are an integer of 0 to 4, x and y each are a real number of 0 to 20, l is 1 or 2, and m is an integer of 2 to 4.

34 Claims, No Drawings

SILVER HALIDE COLOR PHOTOGRAPHIC MATERIAL

FIELD OF THE INVENTION

The present invention relates to silver halide color photographic materials, and particularly to a silver halide color photographic material in which the preservability of the color image thereof has been improved by the use of a sparingly water-soluble epoxy compound. More particularly the present invention relates to a silver halide color photographic material in which the fastness of the yellow image thereof to moisture and heat has been improved by the use of said compound and the color reproduction thereof is excellent.

Further, the present invention relates to a silver halide color photographic material that is excellent in rapid processability and good in color reproduction and tone reproduction and that provides a color print whose three colors, namely, yellow, magenta, and cyan, are fast to approximately the same extent.

BACKGROUND OF THE INVENTION

When color photographic materials are stored as records semipermanently, it is demanded that the extent of light-fading and dark-fading be suppressed as much as possible and that the color balance of three-color fading among the yellow, magenta, and cyan dye images be retained as in the initial state. However, sometimes when color photographic materials are stored in an environment high in humidity, the dark-fading of the yellow dye image is greater than the dark-fading of the other two colors, which greatly deteriorates the image quality.

When the so-called pyrazoloazole magenta couplers, represented by those described in U.S. Pat. Nos. 4,540,654 and 4,882,266, were put in practice, color prints became available that give good sensitometry and good color reproduction in red, are stained less, and are excellent in image preservability.

On the other hand, yellow couplers conventionally used have such defects that the maximum absorption wavelength of the dye to be formed is situated on the long wavelength side for the absorption characteristics preferable for color reproduction and that the absorption in the long wavelength region over 500 nm does not decrease sharply to zero, and therefore these yellow couplers are unsatisfactory to obtain color reproduction excellent for hues such as yellow and green. To obviate such problems, it is considered to use couplers that give a yellow dye whose maximum absorption wavelength is relatively on the short wavelength side, as disclosed, for example, in JP-A ("JP-A" means unexamined published Japanese patent application) No. 173499/1926.

However, when the above magenta coupler, in particular, a magenta coupler having a suitable coupling speed, and the above short wavelength-type yellow coupler are used, although the obtained color photograph is high in density, low in fogging, and excellent in color reproduction, it has been found that when the color photograph is stored for a long period of time, the density of the magenta in the yellow image becomes high, raising a problem of mixing of colors during the storage of the image, and therefore it is desired to favorably keep excellent color reproduction even during the storage of images.

To solve these problems, for example, JP-A Nos. 50048/1989, 50049/1989, and 4041/1986 disclose the use of cyclic ether compounds or epoxy group-containing compounds, but although it is recognized that these compounds are effective to a certain extent for the improvement of dark-fading of yellow dye images due to heat and humidity, the improvement is still insufficient.

SUMMARY OF THE INVENTION

An object of the present invention is to provide a silver halide color photographic material whose fading of the color image during storage for a long time is improved and whose formed dye image has excellent color reproduction.

More particularly, another object of the present invention is to provide a silver halide color photographic material wherein the fading of the yellow image during storage under high humidity and mixing of magenta into the yellow image are improved and the color reproduction is excellent.

Further, another object of the present invention is to provide a silver halide color photographic material that is excellent in rapid processability, good in color reproduction and tone reproduction, whose three colors, i.e., yellow, magenta, and cyan, are fast to irradiation with light to approximately the same extent, and whose red-color-formed part and yellow-color-formed part are prevented from being darkened by light-fading.

Other and further objects, features, and advantages of the invention will appear more fully from the following description.

DETAILED DESCRIPTION OF THE INVENTION

One embodiment of the present invention is a silver halide color photographic material, which comprises in at least one hydrophilic colloid layer on a paper base at least one compound selected from the group consisting of sparingly water-soluble epoxy compounds represented by the following formula (I), (II), or (III), and the pH of the raw paper of said paper base is between 5 and 9.

Formula (I)

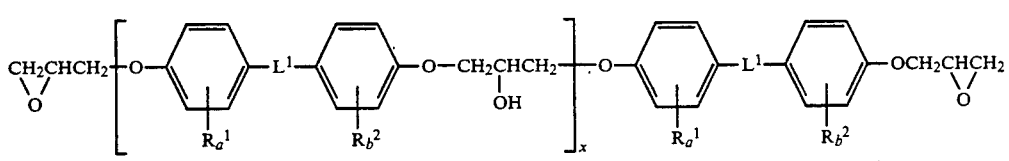

-continued

Formula (II)

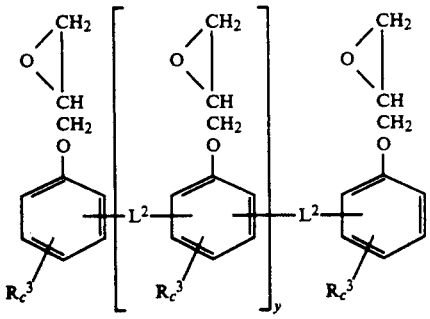

Formula (III)

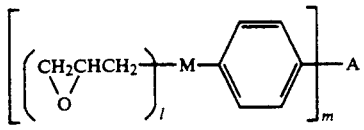

wherein $R^1$, $R^2$, and $R^3$ each represent an alkyl group or a halogen atom, $L^1$ and $L^2$ each represent a bivalent aliphatic organic group, M represents an oxygen atom or a nitrogen atom, A represents a polyvalent linking group, a, b, and c each are an integer of 0 to 4, x and y each are a real number of 0 to 20, l is 1 or 2, and m is an integer of 2 to 4 (herein referred to first embodiment).

Another preferable embodiment of the present invention is a silver halide color photographic material having at least each of a yellow-coupler-containing blue-sensitive silver halide emulsion layer, a magenta-coupler-containing green-sensitive silver halide emulsion layer, and a cyan-coupler-containing red-sensitive silver halide emulsion layer on a base, characterized in that said cyan-coupler-containing photosensitive silver halide emulsion layer comprises a silver halide emulsion having a silver chloride content of 90 mol % or more, said silver halide emulsion is sensitized by inclusion of a red-sensitive sensitizing dye and a blue-sensitive sensitizing dye and/or a green-sensitive sensitizing dye, and said photographic material contains at least one member selected from the group consisting of sparingly water-soluble epoxy compounds represented by the formula (I), (II), or (III) (herein referred to second embodiment).

In this specification and claims, the term "sparingly water-soluble" means that the solubility at 25° C. in water is 10% or below. The epoxy compound of the present invention, together with a coupler or separately from a coupler, is used by emulsifying and dispersing it into a hydrophilic binder, such as an aqueous gelatin solution, by using a surface-active agent. At that time, a high-boiling organic solvent that has a boiling point of 160° C. or higher and that is sparingly soluble in water, or a low-boiling organic co-solvent, may be used. By combined use of the above described epoxy compound with a yellow coupler, a magenta coupler, and/or a cyan coupler, the preservability of the image dye is improved. In the present invention, the combined use with the yellow coupler is particularly preferable in view of a balanced fading between three colors. The coupler and the sparingly water-soluble epoxy compound can be added to separate layers (e.g., an intermediate layer, a protective layer, a layer between the lowermost photosensitive layer and the base, and a nonsensitive layer between a protective layer and the uppermost photosensitive layer), but preferably they are added to the same layer, particularly to the same oil droplets in the case of a yellow coupler of formula (IV) described below.

In the epoxy compound represented by formula (I), (II), or (III), more particularly $L^1$ and $L^2$ include, for example,

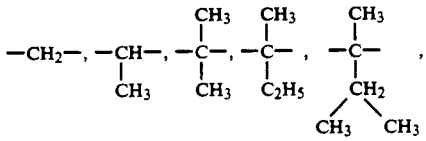

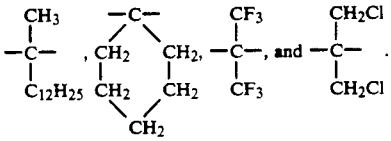

A includes, for example, $-CH_2-$,

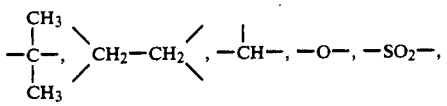

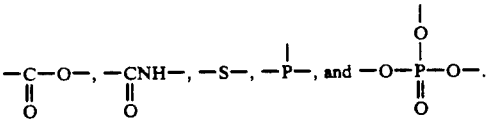

$R^1$, $R^2$, and $R^3$ in formula (I), (II), or (III) represent an alkyl group, which may be straight chain or branched chain, wherein the number of carbon atoms is not restricted (e.g., methyl and ethyl) or a halogen atom (e.g., chlorine, bromine, and fluorine).

Compound examples that can be used in the present invention that are represented by formulas (I), (II), and (III) are specifically given below, but the present invention is not restricted to them.

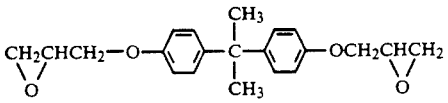

(I-1)

-continued
(I-2)
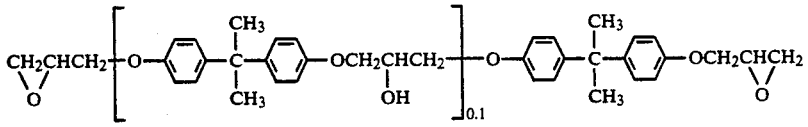
(I-3)
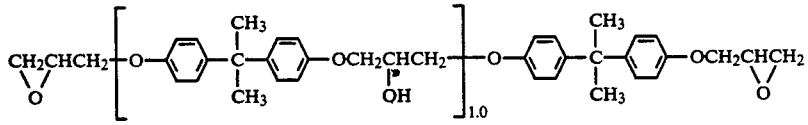
(I-4)
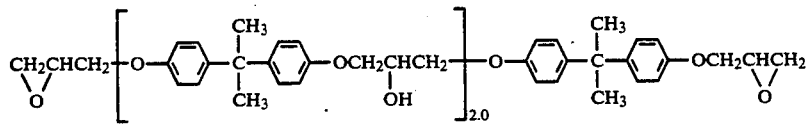
(I-5)
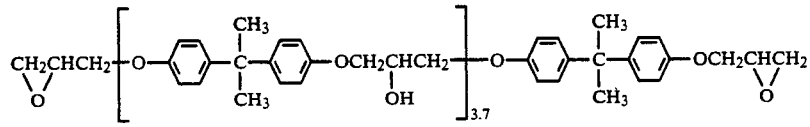
(I-6)
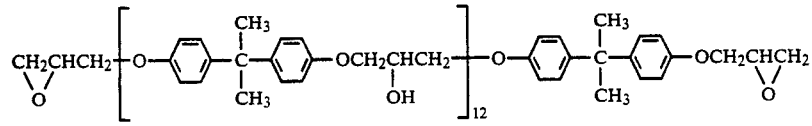
(I-7)
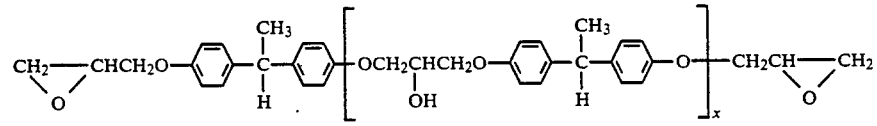
(I-8)
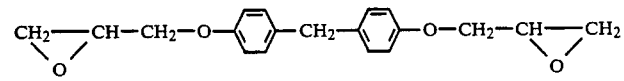
(I-9)
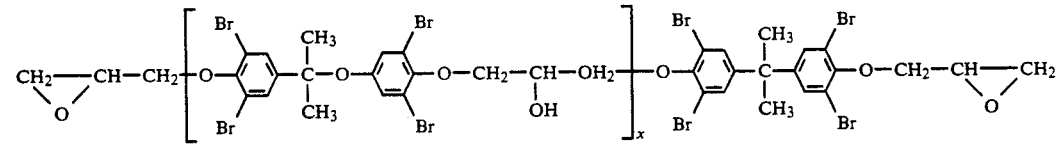
(I-10)
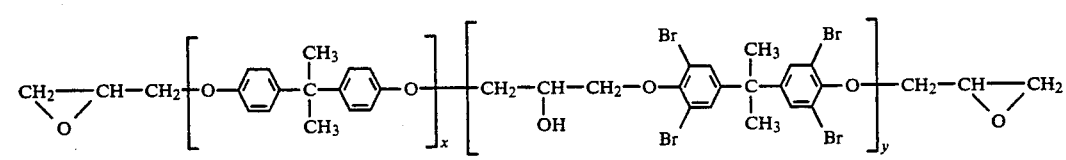
(I-11)
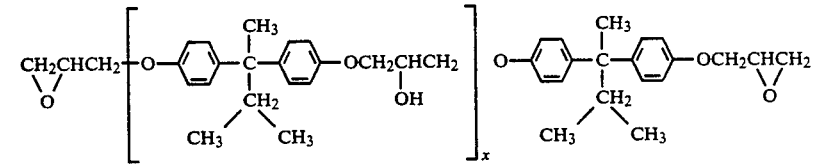
(I-12)
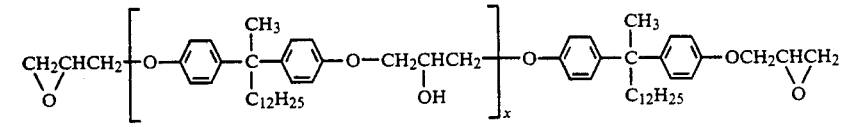

-continued (I-13)

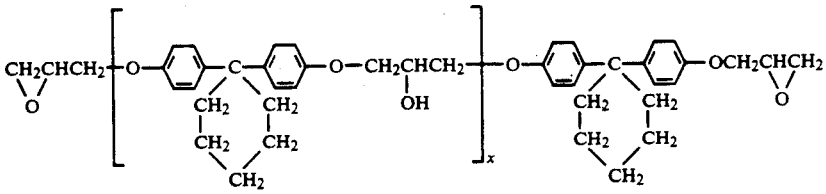

(I-14)

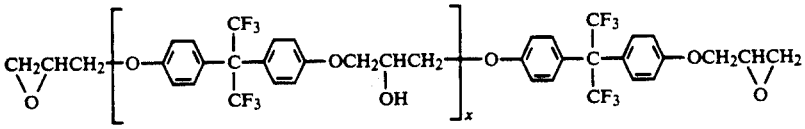

(II-1)

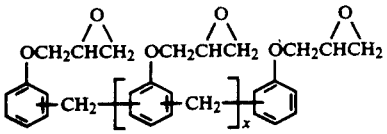

(II-2)

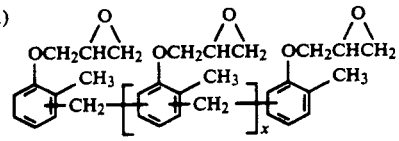

(II-3)

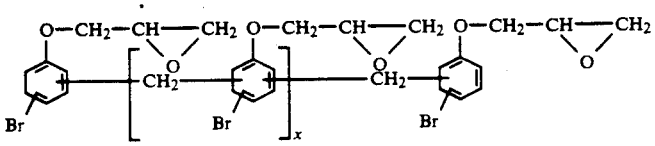

(III-1)

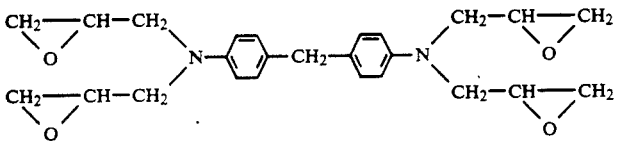

(III-2)

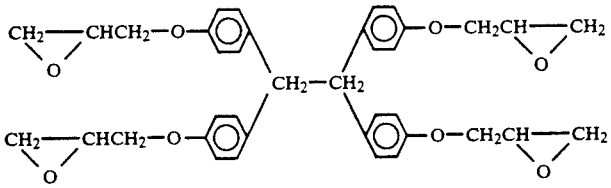

(III-3)

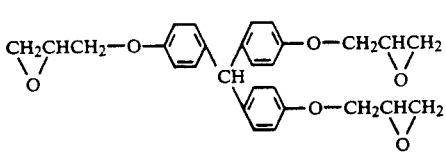

(III-4)

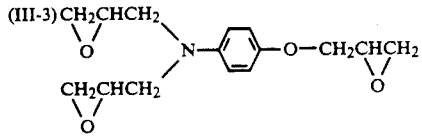

In the above structural formulae, the variable x is a real number and may be any real number in the range of 0 to 20. The reason why x is not necessarily an integer is that epoxy compounds having different integral values are mixed in a certain ratio and the variable x is the average value of the different integral values. These epoxy compounds may be used alone or as a mixture of two or more or they may be used in combination with a high-boiling organic solvent and/or a water-soluble and organic solvent-soluble polymer other than the epoxy compound of the present invention. Preferable examples of the high-boiling organic solvent and the polymer are those disclosed in JP-A No. 537/1989.

The above-mentioned epoxy resin used in the present invention is, for example, one obtained by reacting bisphenol A with epichlorohydrin in the presence of caustic soda (Naoshiro Ooishi, et al., *Purasuchikku Zairyo Koza* (5), *Epokishi Jushi*, Nikkan Kogyo Shinbunsha). As this epoxy resin, a commercially available one can be used, for example, Epikote (manufactured by Shell International Chemicals Corp.), Araldite (manufactured by Ciba Ltd.), Bakelite (manufactured by UCC), and DER (manufactured by Dow Chemical Co.), which are trade names.

The pH value of the raw paper used for the paper base of the present photographic material of the first embodiment is 5 to 9, with preference given to 5.5 to 8.5. In the second embodiment, it is preferable to use the paper base with pH of 5 to 9.

In this specification and claims, the pH value of the raw paper is the value measured according to the hot water extraction method stipulated in JIS (Japanese Industrial Standard) P-8133. The hot water extraction method stipulated in JIS P-8133 is summarized below.

About 1.0 g of a test specimen is weighed and placed in a 100 ml conical flask, 20 ml of distilled water is added, and the test specimen is dipped and wetted uniformly using a stirring rod that has a flattened tip, to allow the test specimen to soften. Then, a further 50 ml of distilled water is added followed by stirring, and then a condenser is attached to the flask. Next the flask is placed in a water bath, so as to keep the contents of the flask at 95° to 100° C. without allowing the water to boil. Having at this temperature is continued for 1 hour with the flask being shaken occasionally, and then, after it is cooled to 20° C.±5° C., the pH of the extract is measured by a glass electrode pH meter as it is.

Details of the above method of measurement and instruments used therein are as stipulated in the Japanese Industrial Standard of 1963.

Now, the constitution of the paper base used in the present invention and the specific means of bringing the pH value of the paper base to 5 to 9 will be described.

The raw paper used for the paper base uses as a major raw material wood pulp, which is made into paper. As the wood pulp, either soft wood pulp or hard wood pulp can be used, although in the present invention it is preferable to use a large amount of short-fiber hard wood pulp. Specifically, preferably 60% by weight or more of the pulp constituting the raw paper is made up of hard wood pulp.

If necessary, part of the wood pulp may be replaced with a synthetic pulp made up, for example, of a polyethylene or a polypropylene or with a synthetic fiber made up, for example, of a polyester, a polyvinyl alcohol, or a nylon.

The drainage rate of the whole pulp to be used for paper making is preferably 150 to 500 ml, more preferably 200 to 400 ml, when measured according to CSF. Preferably, the fiber length after the beating is such that the residue between 24 and 42 mesh stipulated in JIS P-8207 is 40% by weight or less.

Generally, a sizing agent is internally added to the raw paper and in the present invention, since it is required to bring the pH value of the paper base to 5 to 9, preferably a neutral sizing agent, such as an epoxidized fatty amide, a fatty acid anhydride, a rosin acid anhydride, an alkenyl succinic anhydride, a succinic amide, isopropenyl stearate, an aziridine compound, or an alkylketene dimer is used as an internal additive sizing agent.

Generally, a fixing agent for a sizing agent is internally added to the raw paper, and in the present invention, since it is required to bring the pH value of the raw paper to 5 to 9, instead of the aluminum sulfate commonly used as a fixing agent, preferably a neutral or weakly alkaline compound, such as a cationized starch, a polyamide-polyamine epichlorohydrin, a polyacrylic amide, or a polyacrylic amide derivative is used, or aluminum sulfate is added followed by neutralization with an alkali.

Further, into the raw paper, a filler, such as calcium carbonate, talc, clay, kaolin, titanium dioxide, or urea resin in finely divided particles may be added internally for the purpose of improving the smoothness.

As internal additive agents other than the above internal sizing agents fixing agents, and fillers; a paper strengthen agent, such as a polyacrylic amide, a starch, and a polyvinyl alcohol; a softening agent, such as a reaction product of a maleic anhydride copolymer with a polyalkylene polyamine and a quaternary ammonium salt of a higher fatty acid; a colored dye, and a fluorescent dye may be added into the raw paper if required. Preferably these internal additive agents have pH values near neutral, in principle. If it is required to use an acidic or alkaline agent, preferably the amount thereof is made as small as possible.

The raw paper used for the paper base uses the raw materials mentioned above, which can be made into paper by using a Fourdrinier machine or a cylinder machine.

Preferably, the basis weight of the raw paper is 20 to 300 g/m$^2$, particularly preferably 50 to 200 g/m$^2$. Preferably the thickness of the raw paper is 25 to 350 μm, particularly preferably 40 to 250 μm.

For the purpose of improving the smoothness, preferably the raw paper is calendered, for example, by on-machine calender of a paper machine or by supercalender after being made into paper. Preferably, after the above calendering, the density of the raw paper is brought to 0.7 to 1.2 g/m$^3$, particularly preferably 0.85 to 1.10 g/m$^3$, when measured according to JIS P-8118.

By selecting the method of making a raw paper, the internal additive agent (e.g., an internal additive sizing agent and a fixing agent) in particular, and the surface sizing agent as mentioned above, the pH value of the raw paper can be adjusted to 5 to 9.

The photographic material of the present invention can use as a paper base the raw paper described above as it is. A surface sizing agent may be applied to the surface of the raw paper. As examples of the surface sizing agent, a polyvinyl alcohol, a starch, a polyacrylic amide, gelatin, a casein, a styrene/maleic anhydride copolymer, an alkylketene dimer, a polyurethane, and an epoxidized fatty acid amide can be mentioned.

One surface or each of the surfaces of the above raw paper (including one coated with a surface sizing agent) may be provided further with a coating layer. Although there is no particular restriction to the constitution of the said coating layer, preferably the coating layer contains a hydrophobic polymer. By providing a coating layer containing a hydrophobic polymer, the water absorption degree of the paper base decreases, so that straining of the base that will be brought about when a photosensitive layer is applied can be reduced.

The hydrophobic polymer may be either a homopolymer or a copolymer. In the case of a copolymer, it is acceptable as long as the copolymer is hydrophobic overall, even if the copolymer has hydrophilic repeating units partially. As examples of the hydrophobic polymer, a polyethylene, a polypropylene, poly(vinylidene chloride), a styrene/butadiene copolymer, a methyl methacrylate/butadiene copolymer, an acrylonitrile/butadiene copolymer, a styrene/acrylate copolymer, a methyl methacrylate/acrylate copolymer, and a styrene/methacrylate/acrylate copolymer can be mentioned.

A pigment may be added to the coating layer for the purpose of improving the resolving power. As the pigment, known pigments used in coated papers can be used. As examples of the pigment, inorganic pigments, such as titanium dioxide, barium sulfate, talc, clay, kaolin, calcined kaolin, aluminum hydroxide, amorphous silica, crystalline silica, and synthetic silica, and organic pigments, such as a polystyrene resin, an acrylic resin, and a urea-formaldehyde resin, can be mentioned.

The amount of the pigment to be added is suitably 5 to 60% by weight, preferably 8 to 30% by weight, and more preferably 14 to 30% by weight, in the hydrophobic polymer.

To provide the coating layer, for example, the extrusion coating method, the dip coating method, the air-knife coating method, the curtain coating method, the roller coating method, the doctor coating method, or the gravure coating method can be used.

When a coating layer as described above is applied, preferably the coating layer is placed on a raw paper in a coating amount of 1 to 100 g/m$^2$, more preferably 5 to 60 g/m$^2$.

Further, for the purpose of improving the smoothness of the paper base, at the time when the coating layer is applied or after the coating layer is applied, preferably, calendering such as gloss calendering or supercalendering is carried out.

Silver halide emulsion which is contained in a cyan coupler-containing photosensitive silver halide emulsion layer in the second embodiment is required to comprise silver chlorobromide or silver chloride that contains silver chloride of 90 mol % or more. With respect to silver iodide content, it is preferably 0.5 mol % or less, more preferably it is not contained at all. With respect to silver chloride content, it is required to be 90 mol % or more, and it is preferably 95 mol % or more, particularly preferably 98 mol % or more. Emulsion comprising pure silver chloride except that a slight amount of polyvalent metal ions impurities is contained may be used.

However, although a higher silver chloride content is preferable, the silver chloride content of 100 mol % is not preferable in view of the adsorption property of sensitizing dye.

That is, when the silver chloride content is 100 mol %, namely, for example, silver halide other than silver chloride is not contained at all, as the cyan coupler containing silver halide emulsion layer of the present invention has been sensitized in the presence of red-sensitive sensitizing dye and, at the same time, blue-sensitive sensitizing dye and/or green-sensitizing dye, the balance of adsorption amounts or adsorption types of red-sensitive sensitizing dye, and blue-sensitive sensitizing dye and/or green-sensitive sensitizing dye in said silver halide emulsion is liable to become unstable at the time of photographic material preparation, or to occur the change of photographic material property in storage. Thus, it is considered that, because the adsorbing force of sensitizing dye to silver chloride is weak relatively than that to silver bromide, the presence of a little amount of silver bromide is advantageous in view of fixing individual sensitizing dye by strong adsorption.

Further, the sensitivity change, even when the change is such a degree as permissible for a conventional photographic material of which each silver halide emulsion layer has been spectral sensitized by a red-sensitive sensitizing dye alone, a blue-sensitive sensitizing dye alone, or a green-sensitive sensitizing dye alone, may give some effects on the reproduction of color gradation in the present invention. Thus, the silver halide emulsion of the present invention requires to contain a slight amount of silver bromide or silver iodide, avoiding pure silver chloride, and preferably a slight amount of silver bromide is contained on the surface of silver halide grains.

On the basis above mentioned, in the second embodiment, the silver chloride content is preferably 99.9 mol % or less.

When the silver halide emulsion used in the present invention contains silver bromide, the silver bromide may take a variety of forms. That is, it may take the form of the so-called solid solution, wherein the silver bromide is distributed uniformly throughout each of the silver halide grains, or phases containing the silver bromide may be present ununiformly in the silver halide grains. In the latter case, the phases can take various shapes. For example, a so-called layered structure may be formed, wherein phases different in silver bromide content form cores or shells, or localized phases may be formed, wherein phases containing much silver bromide are separated into part of the inside or surface of the grains.

The silver halide emulsion of the present invention may be caused to contain, when the grains are formed, one or more types of polyvalent metal impurity ions for the purpose of obtaining, for example, high sensitivity, high contrast, resistance to a change in the atmosphere at the time of exposure to light, or high latent-image-keeping. As examples thereof, salts or complex salts of the transition metal ions of Group VIII, such as ions of iron, cobalt, nickel, ruthenium, rhodium, palladium, osmium, iridium, or platinum, or salts of divalent metal ions, such as ions of copper, zinc, cadmium, or lead, can be mentioned. As an example wherein these metal impurity ions are applied, a method is disclosed in JP-A No. 183647/1989 that provides a photographic material that is high in sensitivity and contrast and less dependent on exposure temperature by using a high silver chloride containing iron ions and having silver bromide localized phases. JP-A No. 105940/1989 discloses a method that provides a photographic material whose reciprocity law failure is less and whose latent-image keeping is excellent by using a high silver chloride containing Ir in silver bromide localized phases.

In order to attain sufficient rapid processability in the present invention, it is preferable to use, in the yellow coupler-containing blue-sensitive silver halide emulsion layer and the magenta-coupler-containing green-sensitive silver halide emulsion layer, the same high-silver-chloride emulsion as that in the above-mentioned cyan-coupler-containing photosensitive silver halide emulsion layer.

The average grain size of silver halide grains contained in the silver halide emulsion used in the present invention (assuming the diameters of circles equivalent to the projected areas of the grains to be the grain sizes, the number average of the grain sizes being defined as the average grain size) is 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or more, preferably 70% or more, and more preferably 90% or more, are preferred.

Silver chlorobromide or silver chloride emulsion used in the present invention can be prepared by methods described, for example, by Glafkides in *Chimie et Phisique Photographique* (published by Paul Montel, 1967), by G. F. Duffin in *Photographic Emulsion Chemistry* (published by Focal Press, 1966), and by V. L.

Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process can be used as one type of double-jet process. According to the controlled double-jet process, a silver halide emulsion wherein the crystal form is regular and the grain sizes are nearly uniform can be obtained.

The silver halide emulsion for use in the present invention can be chemically sensitized by a sulfur sensitization, a selenium sensitization, a reduction sensitization, or a noble metal sensitization in alone or a combination together. As compounds to be used in a sulfur sensitization can be mentioned thiosulfates, rhodanines, thioureas, and thioamides (compounds described in, for examples, U.S. Pat. Nos. 2,410,689, 3,501,313, 2,278,947, 1,574,944, 2,728,668, 3,656,955, 4,001,025, and 4,116,697, and JP-A No. 45016/1980), thioesters (compounds described in, for example, JP-B Nos. 13485/1968 and 42374/1980 and British Patent No. 1,190,678), polysulfur compounds (compounds described in, for example, U.S. Pat. Nos. 3,647,469, 3,656,955, and 3,689,273, JP-A No. 81230/1978, and JP-B Nos. 20533/1978 and 45134/1984).

As compounds to be used in a selenium sensitization can be mentioned selenium compounds described in, for example, JP-A No. 150046/1975.

As compounds to be used in a reduction sensitization can be mentioned inorganic reductants, such as $SnCl_2$ and $NaBH_4$, amines, hydrazines, formamizinesulfinic acids, and silane compounds (compounds described in, for example, U.S. Pat. Nos. 2,518,698, 2,743,182, 3,369,904, 2,666,700, 2,419,973, 2,419,974, 2,419,975, 2,740,713, 2,521,926, 2,487,850, 2,983,609, 2,983,610, 2,694,637, 3,930,867, and 3,904,415, British Patent NO. 1,390,540, and JP-A Nos. 127622/1975 and 163232/1982), and aldehydes (compounds described in, for example, U.S. Pat. No. 2,604,397).

As compounds to be used in a noble metal sensitization can be mentioned complex salts of transition element of Group VIII, such as gold, platinum, iridium, and paradium (compounds described in, for example, U.S. Pat. Nos. 2,399,083, 2,448,060, 3,503,749, 2,597,856, 2,597,915, 2,624,674, and 2,642,361, and British Patent No. 618,061).

In the silver halide emulsion used in the present invention, various compounds or their precursors can be added for the purpose of preventing fogging that will take place during the process of the production of the photographic material, or stabilizing the photographic performance. Specific examples of these compounds are described in, for example, JP-A No. 215272/1987, pages 39 to 72, which are preferably used.

In the present invention, sensitizing dyes are used as follows. That is, the red-sensitive sensitizing dye is a sensitizing dye whose spectral sensitivity has a peak wavelength at 590 to 720 nm when it is absorbed to a silver chloride emulsion, the blue-sensitive sensitizing dye is a sensitizing dye whose spectral sensitivity has a peak wavelength at 390 to 510 nm when it is absorbed to a silver chloride emulsion, and the green-sensitive sensitizing dye is a sensitizing dye whose spectral sensitivity has a peak wavelength at 510 to 590 nm when it is absorbed to a silver chloride emulsion, and although generally a yellow-coupler-containing blue-sensitive silver halide emulsion layer is sensitized with a blue-sensitive sensitizing dye, a magenta-coupler-containing green-sensitive silver halide emulsion layer is sensitized with a green-sensitive sensitizing dye, and a cyan-coupler-containing red-sensitive silver halide emulsion layer is sensitized with a red-sensitive sensitizing dye, the present invention requires that the cyan-coupler-containing red-sensitive silver halide emulsion layer is further sensitized by inclusion thereon of one or both of a blue-sensitive sensitizing dye and a green-sensitive sensitizing dye.

The amounts and proportions of the spectrally sensitizing dyes to be added to the cyan-coupler-containing red-sensitive silver halide emulsion layer are preferably as follows. That is, preferably the amount of each of the red-sensitive spectrally sensitizing dye, the blue-sensitive spectrally sensitizing dye, and/or the green-sensitive spectrally sensitizing dye to be added is $1\times10^{-6}$ to $1\times10^{-2}$ mol, more preferably $1\times10^{-5}$ to $1\times10^{-3}$ mol, per mol of the silver halide. The proportion of each of the blue-sensitive spectrally sensitizing dye and/or the green-sensitive spectrally sensitizing dye to the red-sensitive spectrally sensitizing dye is preferably from 0.1 to 10 mol, more preferably from 0.5 to 5 mol, and further more preferably from 1 to 3 mol, to 1 mol of the red-sensitive spectrally sensitive dye.

The spectrally sensitizing dyes used in the present invention will now be described specifically in detail.

The spectrally sensitizing dyes used in the present invention include, for example, cyanine dyes, merocyanine dyes, and composite merocyanine dyes. Besides them, composite cyanine dyes, halopolar cyanine dyes, hemicyanine dyes, styryl dyes, and hemioxonol dyes are used. As a cyanine dye, a simple cyanine dye, a carbocyanine dye, or a dicarbocyanine dye is preferably used. These cyanine dyes can be represented by the following formula (V):

Formula (V)

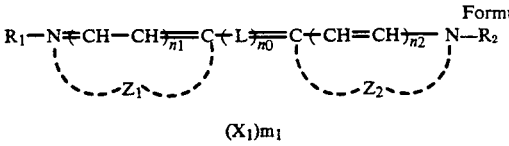

$(X_1)m_1$ wherein L represents a methine group or a substituted methine group, $R_1$ and $R_2$ each represent an alkyl group or a substituted alkyl group, $Z_1$ and $Z_2$ each represent a group of atoms that form a nitrogen-containing 5- to 6-membered heterocyclic nucleus, $X_1$ represents an anion, $n_0$ is a numerical value of 1, 3, or 5, $n_1$ and $n_2$ each are 0 or 1, when $n_0=5$, $n_1$ and $n_2$ each are 0, when $n_0=3$, one of $n_1$ and $n_2$ is 0, $m_1$ is 0 or 1, provided that $m_1$ is 0 when an inner salt is formed, and when $n_0$ is 5, L's may bond together to form a substituted or unsubstituted 5- or 6-membered ring.

The cyanine dye represented by formula (V) will now be described in detail.

The substituent of the substituted methine group represented by L includes a lower alkyl group (e.g., methyl and ethyl) and an aralkyl group (e.g., benzyl and phenetyl).

The alkyl residue represented by $R_1$ and $R_2$ may be straight-chain, branched, or cyclic. Although there is no restriction on the number of carbon atoms of the alkyl residue, preferably the number of carbon atoms is 1 to 8, particularly preferably 2 to 7. The substituent of the substituted alkyl group includes, for example, a sulfonic acid group, a carboxylic acid group, a hydroxyl group, an alkoxy group, an acyloxy group, and an aryl group (e.g., phenyl and substituted phenyl), which may be attached singly or as a combination of two or more to the alkyl group. The sulfonic acid group or the carboxylic group may form together with an alkali metal ion or an organic amine quaternary ion to form a salt. Herein, the term "a combination of two or more" includes a case wherein these groups are independently attached to the alkyl group and a case wherein these groups bond together and are attached to the alkyl group. As examples of the latter case, a sulfoalkoxyalkyl group, a sulfoalkoxyalkoxyalkyl group, a carboxyalkoxyalkyl group, and a sulfophenylalkyl group can be mentioned.

Specific examples of each of $R_1$ and $R_2$ are a methyl group, an ethyl group, an n-propyl group, an n-butyl group, an n-pentyl group, a 2-hydroxyethyl group, a 4-hydroxybutyl group, a 2-acetoxyethyl group, a 3-acetoxy-propyl group, a 2-methoxyethyl group, a 4-methoxybutyl group, a 2-carboxyethyl group, a 3-carboxypropyl group, a 2-(2-carboxyethoxy)ethyl group, a 2-sulfoethyl group, a 3-sulfopropyl group, a 3-sulfobutyl group, a 4-sulfobutyl group, a 2-hydroxy-3-sulfopropyl group, a 2-(3-sulfopropoxy)ethyl group, a 2-acetoxy-3-sulfopropyl group, a 3-methoxy-2-(3-sulfopropoxy)propyl group, a 2-[2-(3-sulfopropoxy)ethoxy]ethyl group, and a 2-hydroxy-3-(3'-sulfopropoxy)propyl group.

Examples of the nitrogen-containing heterocyclic nucleus formed by $Z_1$ or $Z_2$ are an oxazole nucleus, a thiazole nucleus, a selenazole nucleus, an imidazole nucleus, a pyridine nucleus, an oxazoline nucleus, a thiazoline nucleus, a selenazoline nucleus, and an imidazoline nucleus and those formed by condensing a benzene ring, a naphthalene ring, or other saturated or unsaturated carbocyclic ring to them, and these nitrogen-containing heterocyclic ring may have further a substituent (e.g., alkyl, trifluoromethyl, alkoxycarbonyl, cyano, carboxylic acid, carbamoyl, alkoxy, aryl, acyl, hydroxyl, and halogen).

As the anion represented by $X_1$, for example, $Cl^-$, $Br^-$, $I^-$, $SO_4^-$, $NO_3^-$, and $ClO_4^-$ can be mentioned.

In the merocyanine dye or the composite merocyanine dyes, as a nucleus having a ketomethylene structure, a 5- to 6-membered nucleus may be incorporated such as a pyrazololine-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

In the present invention, besides the above spectrally sensitizing dyes, spectrally sensitizing dyes wherein a pyrroline nucleus, an oxazoline nucleus, a thiazoline nucleus, a pyrrole nucleus, a thiazole nucleus, an oxazole nucleus, a selenazole nucleus, an imidazole nucleus, a tetrazole nucleus, or a pyrimidine nucleus or a nucleus formed by fusing an aliphatic hydrocarbon ring or an aromatic hydrocarbon ring with them is incorporated can be used.

As useful spectrally sensitizing dyes, those described, for example, in German Patent No. 929,080, U.S. Pat. Nos. 2,231,658, 2,493,748, 2,503,776, 2,519,001, 2,912,329, 3,656,959, 3,672,897, 3,694,217, 4,025,349, and 4,046,572, British Patent No. 1,242,588, and JP-B ("JP-B" means examined Japanese patent publication) No. 14030/1969 and 24844/1977 can be mentioned.

In the present invention, out of the above dyes, those having a benzothiazole nucleus or a benzooxazole nucleus are preferable, and simple cyanine dyes having a benzothiazole nucleus, carbocyanine dyes having a benzooxazole nucleus and dicarbocyanine dyes having a benzothiazole nucleus, are particularly preferable.

Generally, to spectrally sensitize a silver halide emulsion, a technique wherein after grains are formed completely, a spectrally sensitizing dye is adsorbed to the surface of the grains is used. By contrast, U.S. Pat. No. 2,735,766 discloses a method wherein a merocyanine dye is added during the formation of silver halide grains, thereby allowing unadsorbed dye to be decreased. JP-A No. 26589/1980 discloses a method of the adsorption wherein a spectrally sensitizing dye is added during the addition of an aqueous silver salt solution and an aqueous halide solution that will form silver halide crystalline grains. Thus, the addition of the spectrally sensitizing dye may be during, after, or before the formation of silver halide crystalline grains. Specifically, the term "before the formation" means that a spectrally sensitizing dye is introduced previously in a reaction vessel before the start of the reaction for the formation of silver halide crystals, the term "during the formation of grains" means such a technique described in the above-mentioned patent, and the term "after the formation" means that the addition for the adsorption is carried out substantially after the completion of the step of forming grains. The silver halide emulsion of the present invention is chemically sensitized after the completion of the formation of grains and the addition of a spectrally sensitizing dye after the completion of formation of grains may be before, during, or after the chemical sensitization or at the time when the emulsion is applied. In the present invention, such addition of a spectrally sensitizing dye for the adsorption is preferably carried out at least one step after the stage wherein the formation of silver halide grains is substantially completed. The addition may be carried out at two or more stages or in a divided manner. The addition may be carried out at one stage collectively within a short period of time or continuously over a long period of time. Also, a combination of these addition techniques may be used.

Although the spectrally sensitizing dye to be added may be added in the form of crystals or powder, preferably the spectrally sensitizing dye is added after being dissolved or dispersed by any suitable means. To dissolve the spectrally sensitizing dye, a water-soluble solvent, such as an alcohol having 1 to 3 carbon atoms, acetone, pyridine, and methyl cellosolve or a mixed solvent of these may be used. Alternatively, by using a surface-active agent, a micell dispersion or other dispersion may be formed.

Although the amount of the spectrally sensitizing dye to be added varies depending on the purpose of the spectral sensitization and the contents of the silver halide emulsion, the amount is generally $1\times10^{-6}$ mol to $1\times10^{-2}$ mol, more preferably $1\times10^{-5}$ mol to $5\times10^{-3}$ mol, per mol of the silver halide.

The spectrally sensitizing dyes to be used in the present invention may be used alone or as a mixture of two or more.

Among sensitizing dyes preferably used in the present invention, specific examples of the cyanine dye represented by formula (V) are shown below:
(V-1)
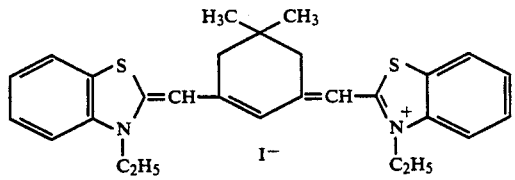
(V-2)
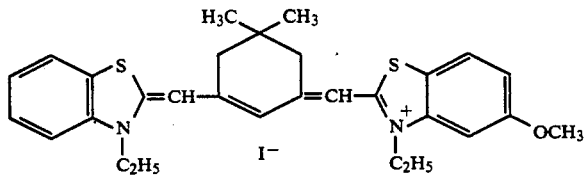
(V-3)
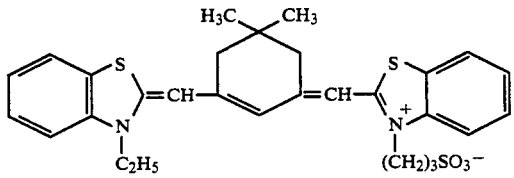
(V-4)
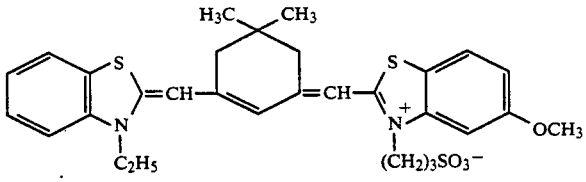
(V-5)
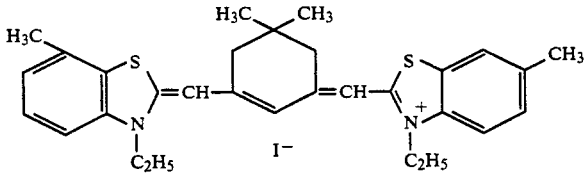
(V-6)
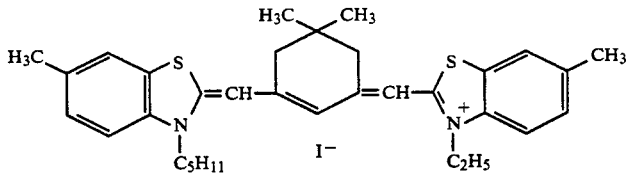
(V-7)
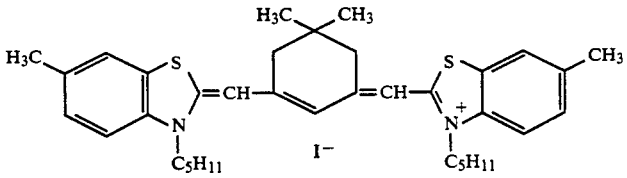
(V-8)
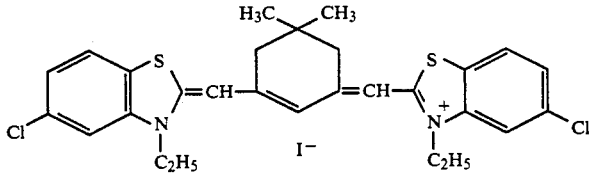

-continued
(V-9)
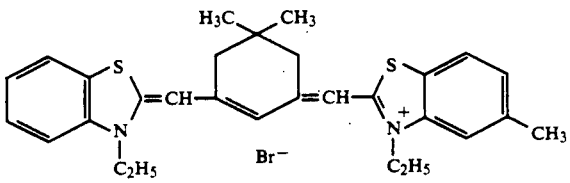
(V-10)
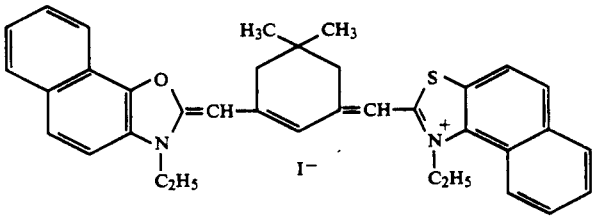
(V-11)
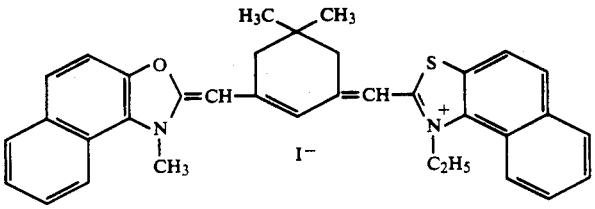
(V-12)
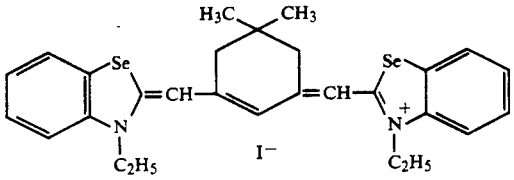
(V-13)
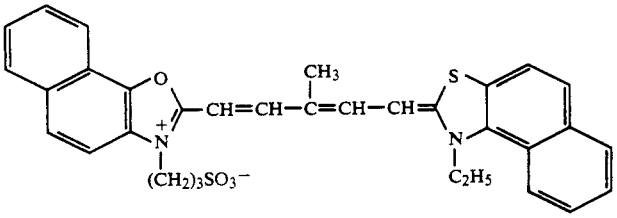
(V-14)
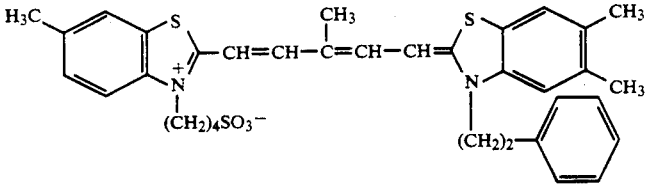
(V-15)
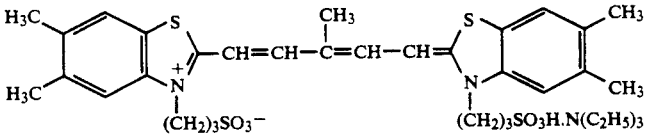
(V-16)
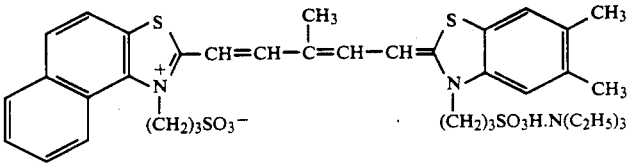

-continued
(V-17)
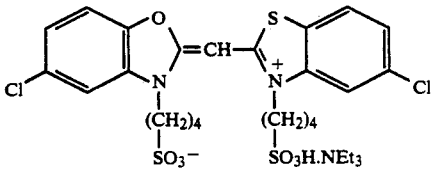
(V-18)
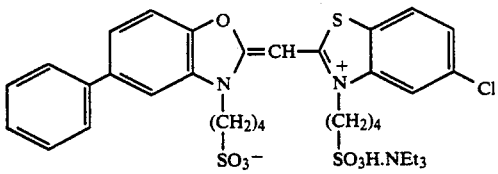
(V-19)
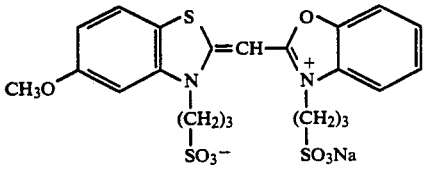
(V-20)
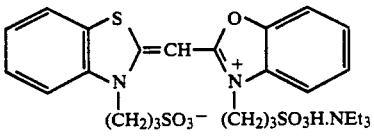
(V-21)
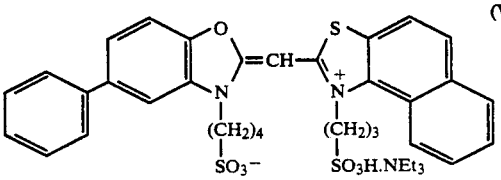
(V-22)
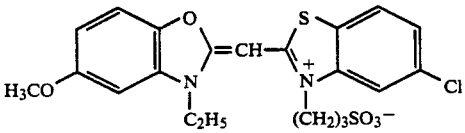
(V-23)
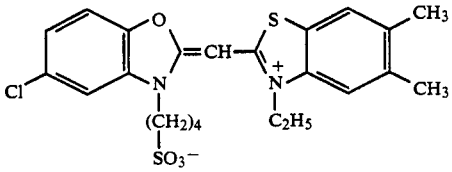
(V-24)
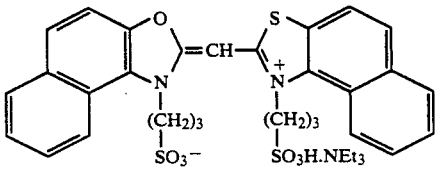
(V-25)
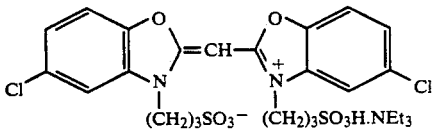
(V-26)
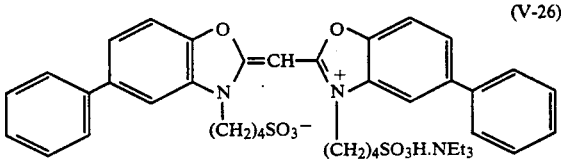
(V-27)
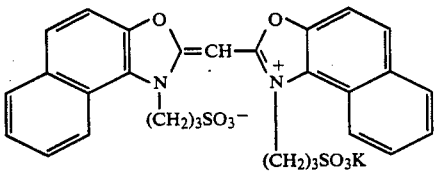
(V-28)
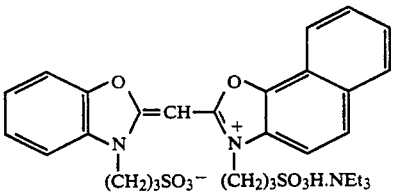
(V-29)
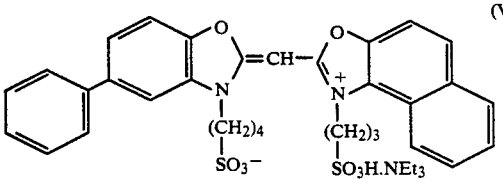
(V-30)
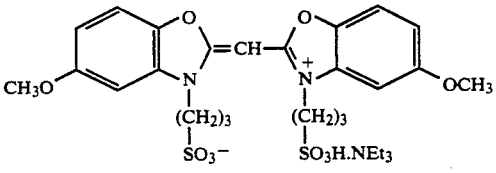
(V-31)
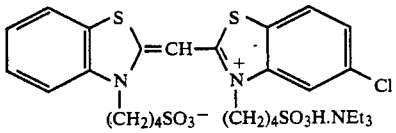
(V-32)
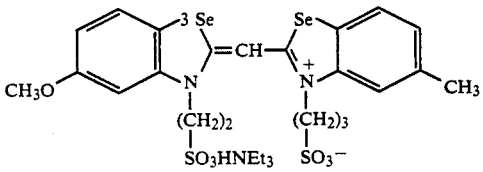

-continued
(V-33)
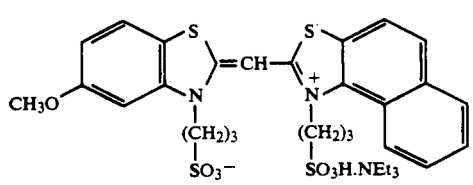
(V-34)
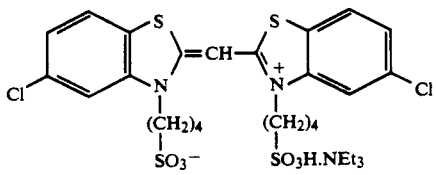
(V-35)
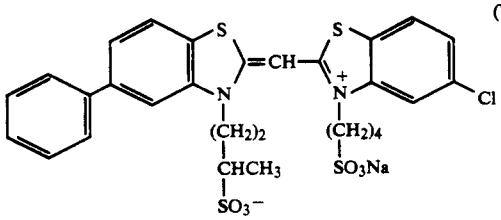
(V-36)
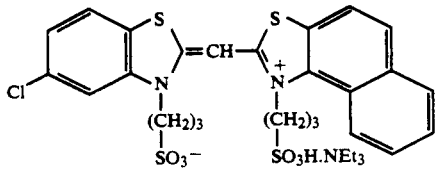
(V-37)
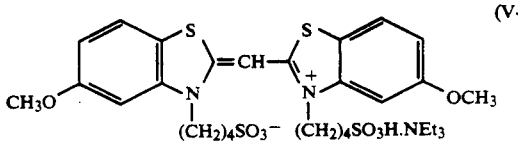
(V-38)
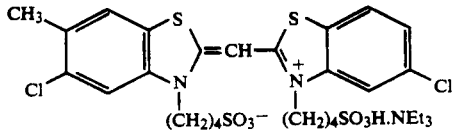
(V-39)
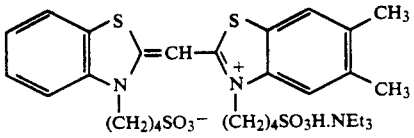
(V-40)
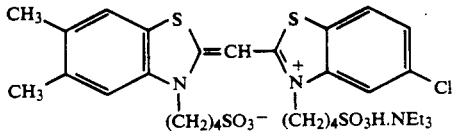
(V-41)
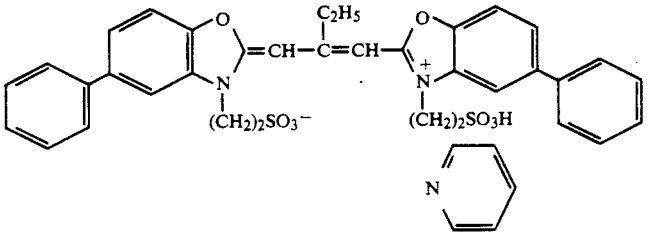
(V-42)
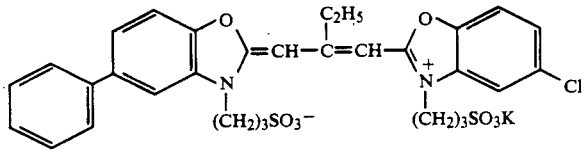
(V-43)
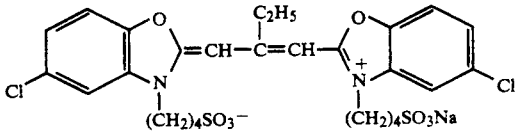
(V-44)
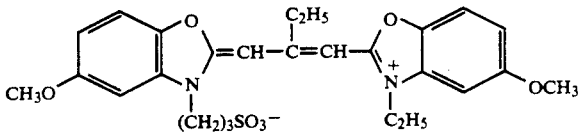
(V-45)
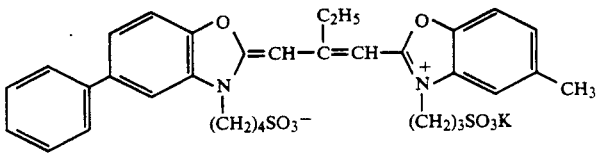

-continued
(V-46)
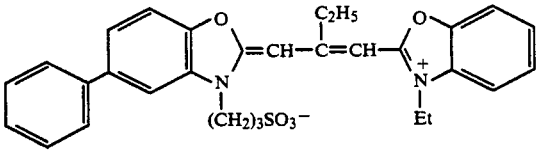
(V-47)
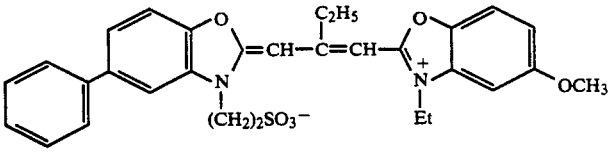
(V-48)
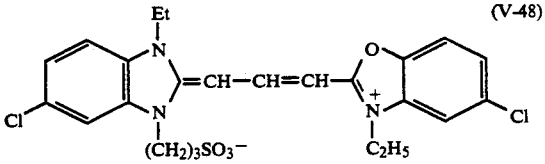
(V-49)
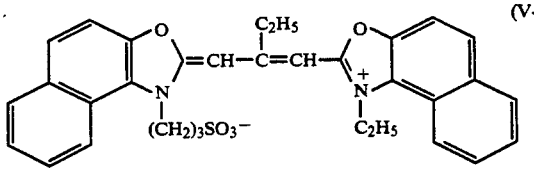
(V-50)
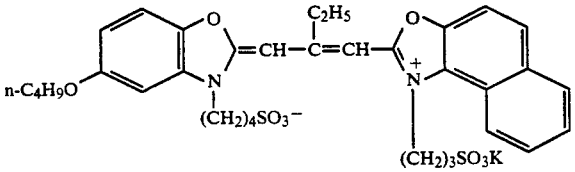
(V-51)
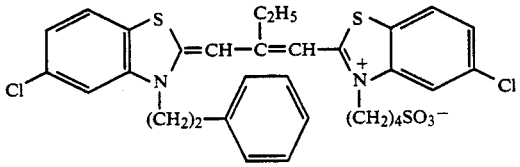
(V-52)
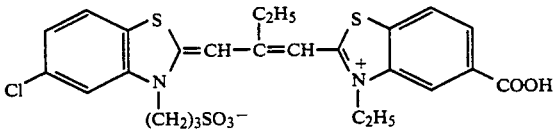
(V-53)
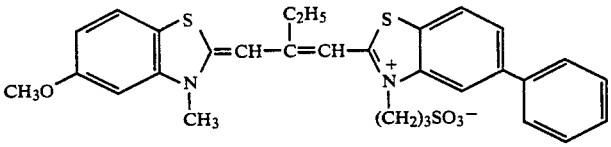
(V-54)
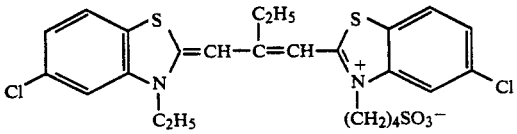
(V-55)
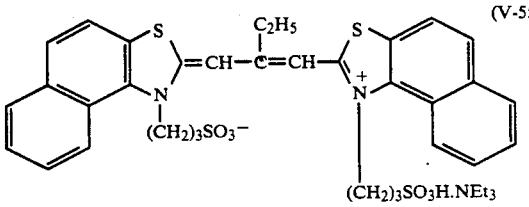
(V-56)
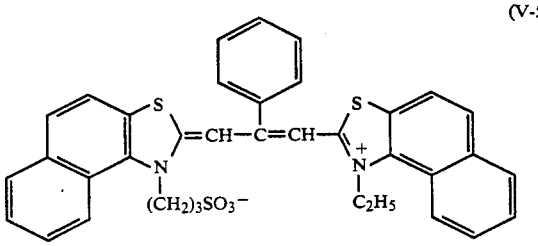

As a yellow coupler to be used in the present invention, a compound having a structure represented by formula (IV) is preferable.

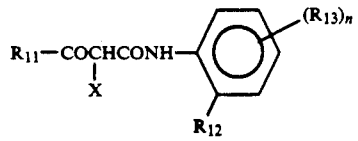

Formula (IV)

wherein $R_{11}$ represents an aryl group or a tertiary alkyl group, $R_{12}$ represents a fluorine atom, an alkyl group, an aryl group, an alkoxy group, an aryloxy group, a dialkylamino group, an alkylthio group, or an arylthio group, $R_{13}$ represents a group capable of substitution onto the benzene ring, X represents a hydrogen atom or a group capable of being released upon a coupling reaction with the oxidized product of an aromatic primary amine developing agent, n is an integer of 0 to 4, and when n is 3 or over, the groups $R_{13}$ may be the same or different.

The compound (IV) of the present invention will now be described in more detail.

In formula (IV), $R_{11}$ preferably represents an aryl group having 6 to 24 carbon atoms (e.g., phenyl, p-tolyl, o-tolyl, 4-methoxyphenyl, 2-methoxyphenyl, 4-butoxyphenyl, 4-octyloxyphenyl, 4-hexadecyloxyphenyl, and 1-naphthyl) or a tertiary alkyl group having 4 to 24 carbon atoms (e.g., t-butyl, t-pentyl, t-hexyl, 1,1,3,3-tetramethylbutyl, 1-adamantyl, 1,1-dimethyl-2-chloroethyl, 2-phenoxy-2-propyl, and bicyclo[2,2,2]octan-1-yl).

In formula (IV), $R_{12}$ preferably represents a fluorine atom, an alkyl group having 1 to 24 carbon atoms (e.g., methyl, ethyl, isopropyl, t-butyl, cyclopentyl, n-octyl, n-hexadecyl, and benzyl), an aryl group having 6 to 24 carbon atoms (e.g., phenyl, p-tolyl, o-tolyl, and 4-methoxyphenyl), an alkoxy group having 1 to 24 carbon atoms (e.g., methoxy, ethoxy, butoxy, n-octyloxy, n-tetradecyloxy, benzyloxy, and methoxyethoxy), an aryloxy having 6 to 24 carbon atoms (e.g., phenoxy, p-tolyloxy, o-tolyloxy, p-methoxyphenoxy, p-dimethylaminophenoxy, and m-pentadecylphenoxy), a dialkylamino group having 2 to 24 carbon atoms (e.g., dimethylamino, diethylamino, pyrrolydino, piperidino, and morpholino), an alkylthio group having 1 to 24 carbon atoms (e.g., methylthio, butylthio, n-octylthio, and n-hexadecylthio), or an arylthio having 6 to 24 carbon atoms (e.g., phenylthio, 4-methoxyphenylthio, 4-t-butylphenylthio, and 4-dodecylphenylthio).

In formula (IV), $R_{13}$ preferably represents a halogen atom (e.g., fluorine, chlorine, bromine, and iodine), an alkyl group having 1 to 24 carbon atoms (e.g., methyl, t-butyl, and n-dodecyl), an aryl group having 6 to 24 carbon atoms (e.g., phenyl, p-tolyl, and p-dodecyloxyphenyl), an alkoxy group having 1 to 24 carbon atoms (e.g., methoxy, n-butoxy, n-octyloxy, n-tetradecyloxy, benzyloxy, and methoxyethoxy), an aryloxy having 6 to 24 carbon atoms (e.g., phenoxy, p-t-butylphenoxy, and 4-butoxyphenoxy), an alkoxycarbonyl group having 2 to 24 carbon atoms (e.g., ethoxycarbonyl, dodecyloxycarbonyl, and 1-(dodecyloxycarbonyl)ethoxycarbonyl), an aryloxycarbonyl having 7 to 24 carbon atoms (e.g., phenoxycarbonyl, 4-t-octylphenoxycarbonyl, and 2,4-di-t-pentylphenoxycarbonyl), a carbonamido group having 1 to 24 carbon atoms (e.g., acetamido, pivaloylamino, benzamido, 2-ethylhexaneamido, tetradecaneamido, 1-(2,4-di-t-pentylphenoxy)-butaneamido, 3-(2,4-di-t-pentylphenoxy)butaneamido, and 3-dodecylsulfonyl-2-methylpropaneamido), a sulfonamido group having 1 to 24 carbon atoms (e.g., methanesulfonamido, p-toluenesulfonamido, and hexadecanesulfonamido), a carbamoyl group having 1 to 24 carbon atoms (e.g., N-methylcarbamoyl, N-tetradecylcarbamoyl, N,N-dihexylcarbamoyl, N-octadecyl-N-methylcarbamoyl, and N-phenylcarbamoyl), a sulfamoyl group having 0 to 24 carbon atoms (e.g., N-methylsulfamoyl, N-phenylsulfamoyl, N-acetylsulfamoyl, N-propanoylsulfamoyl, N-hexadecylsulfamoyl, and N,N-dioctylsulfamoyl), an alkylsulfonyl group having 1 to 24 carbon atoms (e.g., methylsulfonyl, benzylsulfonyl, and hexadecylsulfonyl), an arylsulfonyl group having 6 to 24 carbon atoms (e.g., phenylsulfonyl, p-tolylsulfonyl, p-dodecylsulfonyl, and p-methoxysulfonyl), a ureido group having 1 to 24 carbon atoms (e.g., 3-methylureido group, 3-phenylureido, 3,3-dimethylureido, and 3-tetradecylureido), a sulfamoylamino group having 0 to 24 carbon atoms (e.g., N,N-dimethylsulfamoylamino), an alkoxycarbonylamino group having 2 to 24 carbon atoms (e.g., methoxycarbonylamino, isobutoxycarbonylamino, and dodecyloxycarbonylamino), a nitro group, a heterocyclic group having 1 to 24 carbon atoms (e.g., 4-pyridyl, 2-thienyl, phthalimido, and octadecylsuccinimido), a cyano group, an acyl group having 1 to 24 carbon atoms (e.g., acetyl, benzoyl, and dodecanoyl), an acyloxy group having 1 to 24 carbon atoms (e.g., acetoxy, benzoyloxy, and dodecanoyloxy), an alkylsulfonyloxy group having 1 to 24 carbon atoms (e.g., methylsulfonyloxy and hexadecylsulfonyloxy), or an arylsulfonyloxy group having 6 to 24 carbon atoms (e.g., p-toluenesulfonyloxy and p-dodecylphenylsulfonyloxy).

In formula (IV), n is preferably an integer of 1 or 2.

In formula (IV), X preferably represents a group capable of being released upon a coupling reaction with the oxidized product of an aromatic primary amine developing agent (hereinafter referred to as a coupling split-off group), specifically a halogen atom (e.g., fluorine, chlorine, bromine, and iodine), a heterocyclic group having 1 to 24 carbon atoms that bonds to the coupling active site through the nitrogen atom, an aryloxy group having 6 to 24 carbon atoms, an arylthio group having 6 to 24 carbon atoms (e.g., phenylthio, p-t-butylphenylthio, p-chlorophenylthio, and p-carboxyphenylthio), an acyloxythio group having 1 to 24 carbon atoms (e.g., acetoxy, benzoyloxy, and dodecanoyloxy), an alkylsulfonyloxy group having 1 to 24 carbon atoms (e.g., methylsulfonyloxy, butylsulfonyloxy, and dodecylsulfonyloxy), an arylsulfonyloxy group having 6 to 24 carbon atoms (e.g., benzenesulfonyloxy and p-chlorophenylsulfonyloxy), or a heterocyclic oxy group having 1 to 24 carbon atoms (e.g., 3-pyridyloxy and 1-phenyl-1,2,3,4-tetrazol-5-yloxy) with more preference given to a heterocyclic group that bonds to the coupling active site through the nitrogen atom or an aryloxy group.

When X represents a heterocyclic group that bonds to the coupling active site through the nitrogen atom, X is a heterocyclic ring comprising a 5- to 7-membered optionally substituted monocyclic ring or condensed ring that may contain, in addition to said nitrogen atom, a hetero atom selected from oxygen, sulfur, nitrogen, phosphorus, selenium, and tellurium, and examples thereof include succinimido, maleinimido, phthalimido, diglycolimido, pyrrole, pyrazole, imidazole, 1,2,4-triazole, tetrazole, indole, benzopyrazle, benzimidazole, benzotriazole, imidazolidin-2,4-dione, oxyazolidin-2,4-dione, thiazolidin-2,4-dione, imidazolidin-2-one, oxazolin-2-one, thiazolin-2-one, benzimidazolin-2-one, benzooxazolin-2-one, benzothiazolin-2-one, 2-pyrrolin-5-one, 2-imidazolin-5-one, indolin-2,3-dione, 2,6-dioxypurine, parabanic acid, 1,2,4-triazolidin-3,5-dione, 2-pyridone, 4-pyridone, 2-pyrimidone, 6-pyridazone, and 2-pyrazone, which may be substituted. Examples of the substituent include a hydroxyl group, a carboxyl group, a sulfo group, an amino group (e.g., amino, N-methylamino, N,N-dimethylamino, N,N-diethylamino, anilino, pyrrolidino, piperidino, and morpholino) and those substituents mentioned as examples of $R_{13}$.

When X represents an aryloxy group, X is an aryloxy group having 6 to 24 carbon atoms, and when X represents a heterocyclic group, X may be substituted by a group selected from the group consisting of those substituents mentioned above. Preferably the substituent is a carboxyl group, a sulfo group, a cyano group, a nitro group, an alkoxycarbonyl group, a halogen atom, a carbonamido group, a sulfonamido group, a carbamoyl group, a sulfamoyl group, an alkyl group, an alkylsulfonyl group, an arylsulfonyl group, or an acyl group.

Examples of the substituents $R_{11}$, $R_{12}$, $R_{13}$, and X that are particularly preferably used in the present invention will now be described.

In formula (IV), particularly preferably $R_{11}$ represents a 2- or 4-alkoxyaryl group (e.g., 2-methoxyphenyl, 2-butoxyphenyl, and 2-methoxyphenyl), or a t-butyl group, most preferably a t-butyl group.

In formula (IV), $R_{12}$ particularly preferably represents a methyl group, an ethyl group, an alkoxy group, an aryloxy group, or a dialkylamino group, most preferably a methyl group, an ethyl group, an alkoxy group, an aryloxy group, or a dimethylamino group.

In formula (IV), $R_{13}$ particularly preferably represents an alkoxy group, a carbonamido group, or a sulfonamido group.

In formula (IV), X particularly preferably represents a heterocyclic group that bonds to the coupling active site through a nitrogen atom or an aryloxy group.

When X represents the above heterocyclic group, X is preferably represented by the following formula (VI):

Formula (VI)

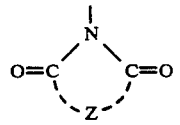

In formula (VI), Z represents

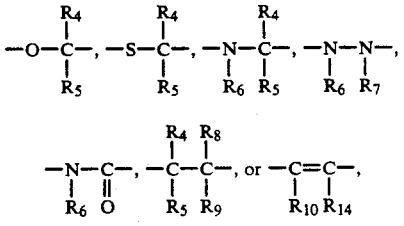

wherein $R_4$, $R_5$, $R_8$ and $R_9$, same or different, each represent a hydrogen atom, an alkyl group (as defined above), an aryl group (as defined above), an alkoxy group having C-number of 1 to 24, an aryloxy group having C-number of 6 to 24, an alkylthio group having C-number of 1 to 24, an arylthio group having C-number of 6 to 24, an alkylsulfonyl group having C-number of 1 to 24, an arylsulfonyl group having C-number of 6 t 24, or an amino group, any of which may be substituted (except hydrogen); $R_6$ and $R_7$ each represent a hydrogen atom, an alkyl group (as defined above), an aryl group (as defined above), an alkylsulfonyl group having C-number of 1 to 24, an arylsulfonyl group having C-number of 6 to 24, or an alkoxycarbonyl group having C-number of 1 to 24, any of which may be substituted (except hydrogen); $R_{10}$ and $R_{14}$ each represent a hydrogen atom, an alkyl group (as defined above), or an aryl group (as defined above), $R_{10}$ and $R_{14}$ may bond together to form a benzene ring, and $R_4$ and $R_5$, $R_5$ and $R_6$, $R_6$ and $R_7$, or $R_4$ and $R_8$ may bond together to form a 3 to 8 membered heterocyclic or hydrocarbon ring (e.g., cyclobutane, cyclohexane, cycloheptane, cyclohexene, pyrrolidine, and piperidine), any of which groups may be substituted (except hydrogen).

Among the heterocyclic groups represented by formula (VI), particularly preferable ones are heterocyclic groups wherein Z represent

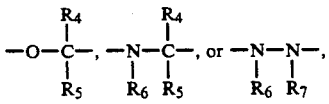

and $R_4$, $R_5$, $R_6$ and $R_7$, same or different are as defined above.

The total number of carbon atoms of the heterocyclic group represented by formula (IV) is 2 to 24, preferably 4 to 20, and more preferably 5 to 16. Examples of the heterocyclic group represented by formula (VI) are a succinimido group, a maleinimido group, a phthalimido group, a 1-methylimidazolidin-2,4-dion-3-yl group, a 1-benzylimidazolidin-2,4-dion-3-yl group, a 5,5-dimethyloxazolidin-2,4-dion-3-yl group, a 5-methyl-5-propiooxazolidin-2,4-dion-3-yl group, a 5,5-dimethylthiazolidin-2,4-dion-3-yl group, a 5,5-dimethylimidazolidin-2,4-dion-3-yl group, a 3-methylimidazolidintrion-1-yl group, a 1,2,4-triazolidin-3,5-dion-4-yl group, a 1-methyl-2-phenyl-1,2,4-triazolidin-3,5-dion-4-yl group, a 1-benzyl-2-phenyl-1,2,4-triazin-3,5-dion-4-yl group, a 5-hexyloxy-1-methylimidazolidin-2,4-dion-3-yl group, a 1-benzyl-5-ethoxyimidazolidin-2,4-dion-3-yl group, and a 1-benzyl-5-dodecyloxyimidazolidin-2,4-dion-3-yl group.

Among above heterocyclic groups, an imidaxolidin-2,4-dion-3-yl group (e.g., 1-benzylimidazolidin-2,4-dion-3-yl) is the most preferably group.

When X represents an aryloxy group, the most preferable examples are a 4-carboxyphenoxy group, a 4-methylsulfonylphenoxy group, a 4-(4-benzyloxyphenylsulfonyl)phenoxy group, a 4-(4-hydroxyphenylsulfonyl)phenoxy group, a 2-chloro-4-(3-chloro-4-hydroxyphenylsulfonyl)phenoxy group, a 4-methoxycarbonylphenoxy group, a 2-chloro-4-methoxycarbonylphenoxy group, a 2-acetamido-4-methoxycarbonylphenoxy group, a 4-isopropoxycarbonylphenoxy group, a 4-cyanophenoxy group, a 2-[N-(2-hydroxyethyl)carbamoyl]phenoxy group, a 4-nitrophenoxy group, a 2,5-dichlorophenoxy group, a 2,3,5-trichlorophenoxy group, a 4-methoxycarbonyl-2-methoxyphenoxy group, and a 4-(3-carboxypropaneamido)phenoxy group.

The coupler represented by formula (IV) may form a dimer or higher polymer by bonding at the substituent $R_1$, X or

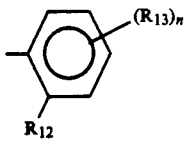

through a bivalent group or a higher polyvalent group, in which case the number of carbon atoms may exceed tha number of carbon atoms defined for the substituents.

When the coupler represented by formula (VI) forms a polymer, a typical example is a homopolymer or a copolymer of an addition polymerized ethylenically unsaturated compound having a yellow dye-forming coupler residue (a yellow-forming monomer). In that case, the polymer contains repeating units represented by formula (VII) and may contain one or more types of yellow-forming repeating units represented by formula (VII), which may also form a copolymer comprising one or more non-color-forming ethylenically unsaturated monomers as a copolymerizable component.

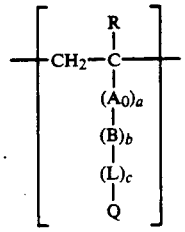

wherein R represents a hydrogen atom, an alkyl group having 1 to 4 carbon atoms, or a chlorine atom, $A_O$ represents —CONH—, —COO—, or a substituted or unsubstituted phenylene group, B represents a substituted or unsubstituted alkylene group, phenylene group, or aralkylene group, L represents —CONH—, —NHCONH—, —NHCOO—, —NHCO—, —OCONH—, —NH—, —COO—, —OCO—, —CO—, —O—, —S—, —$SO_2$—, —$NHSO_2$— or —$SO_2NH$—, a, b, and c each are 0 or 1, and Q represents a yellow coupler residue formed by eliminating a hydrogen atom from $R_{11}$, X or

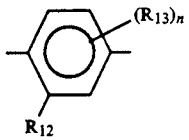

of the compound represented by formula (IV).

Preferably, the polymer is a copolymer of a yellow-forming monomer represented by the coupler unit of formula (VII) with the following non-color-forming ethylenically unsaturated monomer.

The non-color-forming ethylenically unsaturated monomer that will not couple with the oxidized product of an aromatic primary amine developing agent includes, for example, acrylic acid, α-chloroacrylic acid, an α-alkylacrylic acid (e.g., methacrylic acid), an amide or ester derived from such an α-alkylacrylic acid (e.g., acrylamide, methacrylamide, n-butyl acrylamide, t-butyl acrylamide, diacetone acrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxymethacrylate), a vinyl ester (e.g., vinyl acetate, vinyl propionate, and vinyl laurate), acrylonitrile, methacrylonitrile, an aromatic vinyl compound (e.g., styrene and its derivative such as vinyltoluenene, divinylbenzene, vinylacetophenone, and sulfostyrene), itaconic acid, citraconic acid, crotonic acid, vinylidene chloride, a vinyl alkyl ether (e.g., vinyl ethyl ether), a maleate, N-vinyl-2-pyrrolidone, N-vinylpyridine, and 2-and 4-vinylpyridines.

Particularly, an acrylate, a methacrylate, and a maleate are preferable. The non-color forming ethylenically unsaturated monomers herein may be used as a mixture of two or more. For example, a combination of methyl acrylate and butyl acrylate, a combination of butyl acrylate and styrene, a combination of butyl methacrylate and methacrylic acid, and a combination of methyl acrylate and diacetone acrylamide may be used.

As is well known in the field of polymer couplers, an ethylenically unsaturated monomer that will be copolymerized with the vinyl monomer corresponding to formula (VII) can be selected in such a way that the physical properties and/or chemical properties of the intended copolymer, such as the solubility, the compatibility with the binder of the photographic colloid composition, such as gelatin, the flexibility, and the thermal stability will be affected favorably.

The yellow polymer coupler used in the present invention may be prepared by polymerizing a vinyl monomer that can give a coupler unit represented by formula (VII) to form a lipophilic polymer coupler, by dissolving the lipophilic polymer coupler in an organic solvent, and by emulsifying and dispersing the solution in an aqueous gelatin solution to form a latex, or it may be prepared by direct emulsification polymerization.

As a method for emulsifying and dispersing a lipophilic polymer coupler in an aqueous gelatin solution to form a latex, the method described in U.S. Pat. No. 3,452,820 can be used, and as for emulsion polymerization, the methods described in U.S. Pat. Nos. 4,080,211 and 3,370,952 can be used.

Specific examples of $R_{13}$ and X of the yellow dye-forming coupler represented by formula (IV) are given below, but the present invention is not restricted to them. Specified examples of X are shown below.

(1)

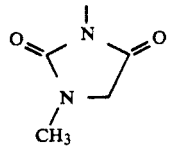

(2)

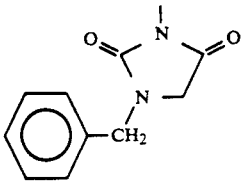

-continued
(3)
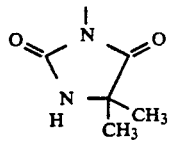
(4)
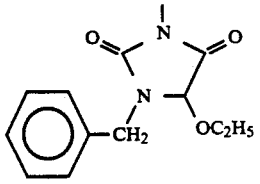
(5)
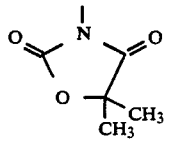
(6)
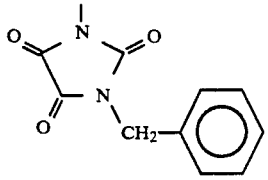
(7)
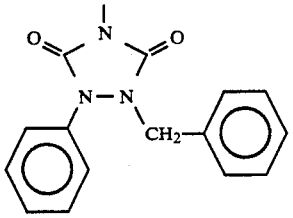
(8)
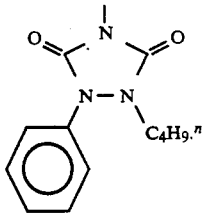
(9)
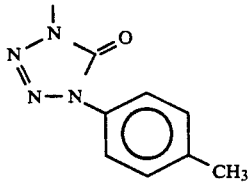
(10)
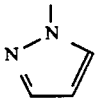
-continued
(11)
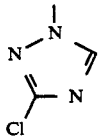
(12)
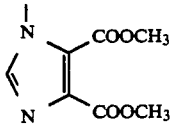
(13)
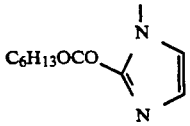
(14)
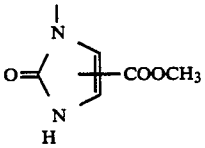
(15)
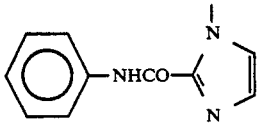
(16)
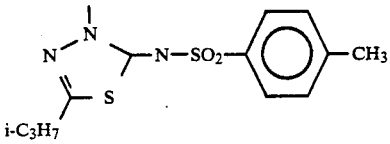
(17)
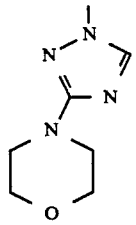
(18)
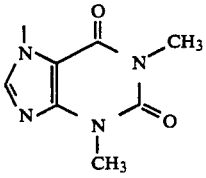
(19)
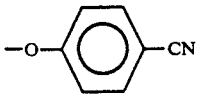
(20)
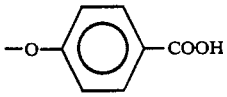

-continued (21)

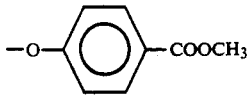

(22)

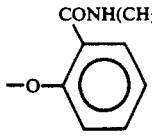

(23)

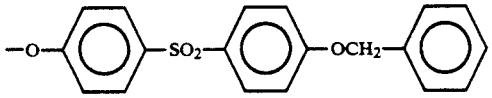

(24)

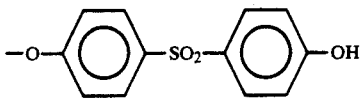

(25)

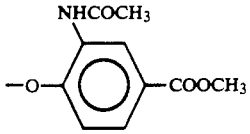

Specified examples of $R_{13}$ are shown below.

(30) $-NHCOC_{13}H_{27}$-n (31)

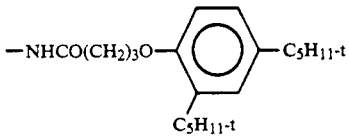

(32)

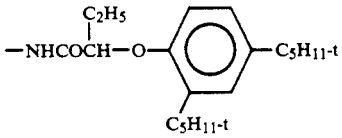

(33) $-NHCOCH(CH_3)CH_2SO_2C_{12}H_{25}$ (34)

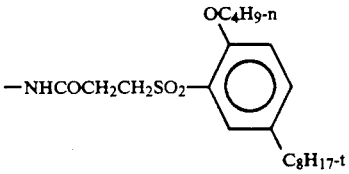

(35) $-OC_{16}H_{33}$-n

(36) $-NHCOCH(C_6H_{13})C_8H_{17}$-n (37)

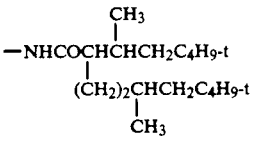

(38)

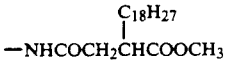

-continued

(39) $-NHSO_2C_{12}H_{25}$-n

(40) $-NHSO_2C_{16}H_{33}$-n (41)

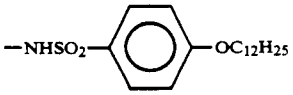

(42) $-COOC_{12}H_{25}$

(43) $-COOCH(CH_2)COOC_{12}H_{25}$

(44) $-CONHC_{14}H_{29}$

(45) $-OC_8H_{17}$-n (46)

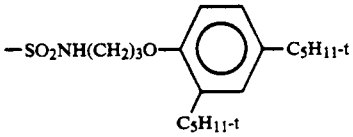

(47) $-CONH(CH_2)_3OC_{12}H_{25}$

(48) $-NHCOC_{15}H_{31}$-n

Specified examples of yellow dye-forming coupler represented by formula (IV) are shown below.

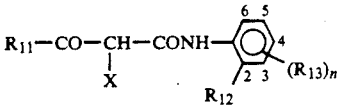

| No. | $R_{11}$ | $R_{12}$ | $(R_{13})_n$ | X |
|---|---|---|---|---|
| Y-1 | t-$C_4H_9$— | —$OCH_3$ | (32)[5] | (4) |
| Y-2 | t-$C_4H_9$— | —$OCH_3$ | (32)[5] | (5) |
| Y-3 | t-$C_4H_9$— | —$CH_3$ | (31)[5] | (2) |
| Y-4 | t-$C_4H_9$— | 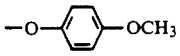 | (32)[5] | (5) |
| Y-5 | t-$C_4H_9$— | 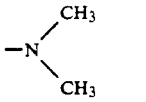 | (32)[5] | (4) |
| Y-6 | t-$C_4H_9$— | —$OCH_3$ | (33)[5] | (2) |
| Y-7 | t-$C_4H_9$— | —$OC_2H_5$ | (33)[5] | (7) |
| Y-8 | t-$C_4H_9$— | —$OCH_3$ | (31)[5] | (23) |
| Y-9 | t-$C_4H_9$— | 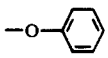 | (40)[5] | (19) |
| Y-10 | t-$C_4H_9$— | —$OC_8H_{17}$-n | (45)[4] | (5) |
| Y-11 | t-$C_4H_9$— | —$OC_8H_{17}$-n | (45)[5] | (5) |
| Y-12 | t-$C_4H_9$— | —$OCH_3$ | (42)[5] | (4) |
| Y-13 | t-$C_4H_9$— | 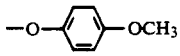 | (30)[5] | (10) |
| Y-14 | t-$C_4H_9$— | —$OC_{16}H_{33}$-n | — | (15) |
| Y-15 | t-$C_4H_9$— | —$OCH_2CH_2OCH_3$ | (34)[5] | (8) |
| Y-16 | t-$C_4H_9$— | —$CH_3$ | (43)[5] | (9) |
| Y-17 | t-$C_4H_9$— | —$OC_2H_5$ | (47)[5] | (8) |
| Y-18 | t-$C_4H_9$— | —$OCH_3$ | (46)[5] | (2) |
| Y-19 | t-$C_4H_9$— | —$OC_8H_{17}$-n | (45)[4], (45)[4] | (5) |
| Y-20 | t-$C_4H_9$— | —$OCH_3$ | (31)[5] | (19) |

-continued

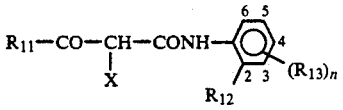

| No. | $R_{11}$ | $R_{12}$ | $(R_{13})_n$ | X |
|---|---|---|---|---|
| Y-21 | t-$C_4H_9$— | $-N(CH_3)_2$ | (36)[4] | (18) |
| Y-22 | t-$C_4H_9$— | $-O-C_6H_4-OCH_3$ | (41)[5] | (11) |
| Y-23 | t-$C_4H_9$— | $-O-C_6H_4-CH_3$ | (37)[5] | (3) |
| Y-24 | t-$C_4H_9$— | $-OC_2H_5$ | (37)[5] | (1) |
| Y-25 | t-$C_4H_9$— | $-CH_3$ | (38)[5] | (2) |
| Y-26 | t-$C_4H_9$— | $-C_2H_5$ | (38)[5] | (2) |
| Y-27 | t-$C_4H_9$— | $-CH_3$ | (33)[5] | (2) |
| Y-28 | $CH_3O-C_6H_4$— | $-OCH_3$ | (42)[5] | (4) |
| Y-29 | $CH_3O-C_6H_4$— | $-N(CH_3)_2$ | (40)[5] | (4) |
| Y-30 | $C_6H_4-OCH_3$ | $-CH_3$ | (43)[5] | (2) |

In the Table, figures in parentheses ( ) stand for numbers attached to the above specific examples of X and $R_{13}$, and figures in brackets [] stand for the substitution position on the anilido group.

The couplers of the present invention may be used alone or as a mixture of two or more, and they may also be used in combination with known yellow dye-forming couplers.

Although the coupler of the present invention can be used in any layer of the photographic material, preferably it is used in a photosensitive silver halide emulsion layer or a layer adjacent thereto, most preferably in a photosensitive silver halide emulsion layer.

The coupler of the present invention can be synthesized by the prior known synthesis method, and as a specific example thereof the synthesis method described in JP-A No. 123047/1988 can be mentioned.

The amount of the coupler of the present invention to be used in the photographic material is $1\times10^{-5}$ to $10^{-2}$ mol, preferably $1\times10^{-4}$ to $5\times10^{-3}$ mol, and more preferably $2\times10^{-4}$ to $10^{-3}$ mol, per $m^2$.

The compound represented by formula (M-II) will now be described below in detail.

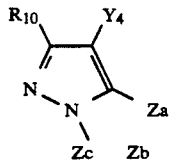

Formula (M-II)

In formula (M-II), $R_{10}$ represents a hydrogen atom or a substituent; $Y_4$ represents a hydrogen atom or a coupling split-off group, particularly preferably a halogen atom or an arylthio group; Za, Zb, and Zc each represent methine, substituted methine, =N—, or —NH—; one of the Za—Zb bond and the Zb—Zc bond is a double bond and the other is a single bond; if the Zb—Zc bond is a carbon-carbon double bond it includes the case wherein it is part of the aromatic ring; a dimer or polymer may be formed through $R_{16}$ or $Y_4$, and if Za, Zb, or Zc represents substituted methine, a dimer or polymer may be formed through the substituted methine.

The compound represented by formula (M-II) is known as a pyrazoloazole coupler. Out of the pyrazoloazole couplers of the present invention, imidazo[1,2-b]pyrazoles described in U.S. Pat. No. 4,500,630 are preferable, and pyrazolo[1,5-b][1,2,4]-triazole, described in U.S. Pat. No. 4,540,654, is particularly preferable.

Pyrazolotriazole couplers having a branched alkyl group attached directly to the 2-, 3-, or 6-position of the pyrazolotriazole ring, as described in JP-A No. 65245/1986, pyrazoloazole couplers having an alkoxyphenylsulfonamido ballasting group containing a sulfonamido group in the molecule, as described in JP-A No. 65246/1986, and pyrazolotriazole couplers having an aryloxy group or an alkoxy group at the 6 position, as described in European Patent (publication) Nos. 226,849 and 294,785, are preferably used.

Specific examples of the pyrazoloazole coupler represented by formula (M-II) are listed below, but the present invention is not restricted to them.

| Compound | $R_{10}$ | $R_{15}$ | $Y_4$ |
|---|---|---|---|
| | | 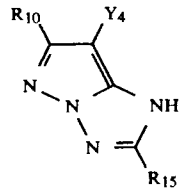 | |
| M-1 | $CH_3$— | 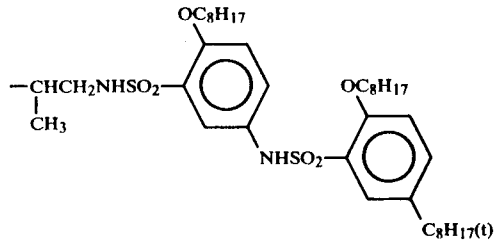 | Cl |
| M-2 | The same as the above | 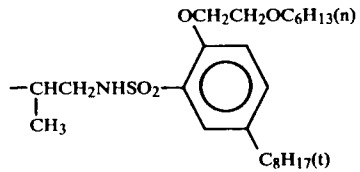 | The same as the above |
| M-3 | $(CH_3)_3C$— | 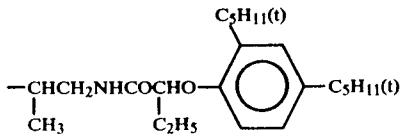 | 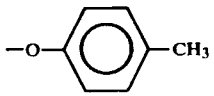 |
| M-4 | 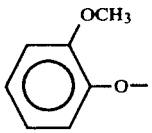 | 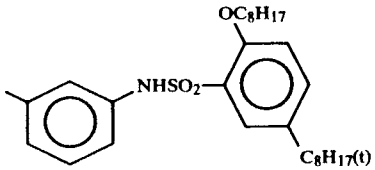 | 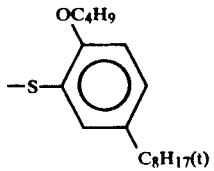 |

-continued
| | | | |
|---|---|---|---|
| M-5 | $CH_3$— | 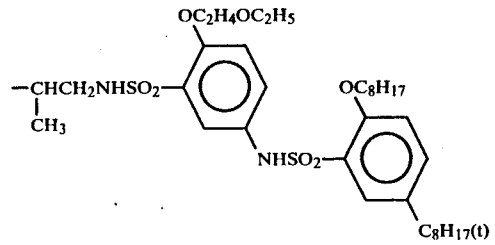 | Cl |
| M-6 | The same as the above | 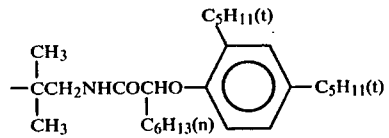 | The same as the above |
| M-7 | The same as the above | 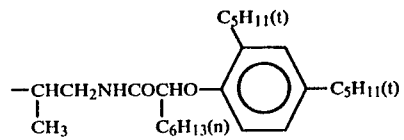 | The same as the above |
| M-8 | The same as the above | 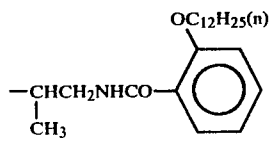 | The same as the above |
| M-9 | $CH_3$— | 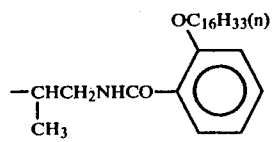 | Cl |

-continued
| | | | |
|---|---|---|---|
| M-10 | 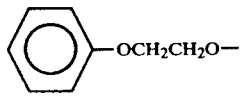 | 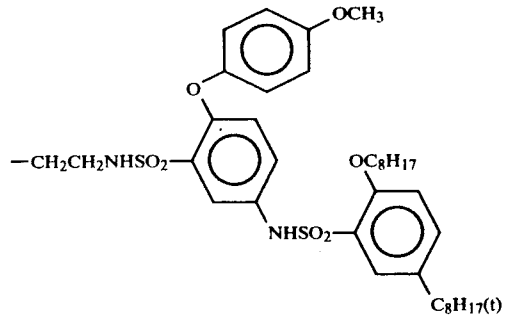 | 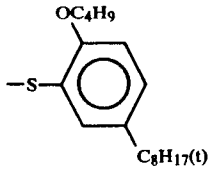 |
| M-11 | $CH_3CH_2O-$ | The same as the above | The same as the above |
| M-12 | 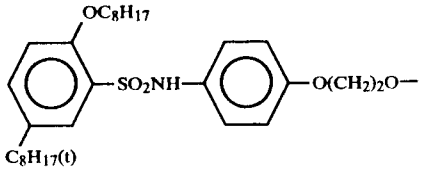 | 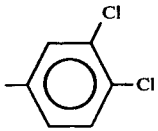 | 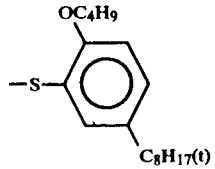 |
| M-13 | 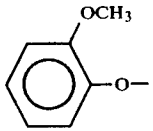 | 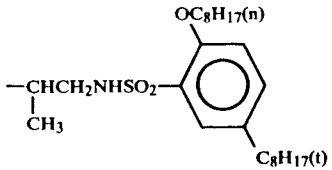 | Cl |
| | 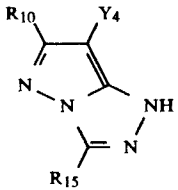 | | |
| M-14 | $CH_3-$ | 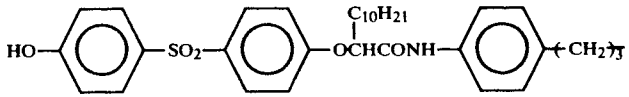 | Cl |

-continued
| | | | |
|---|---|---|---|
| M-15 | The same as the above | 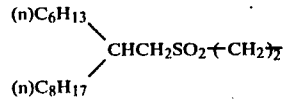 | The same as the above |
| M-16 | 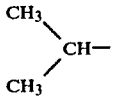 | 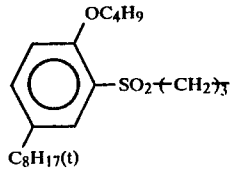 | The same as the above |
| M-17 | 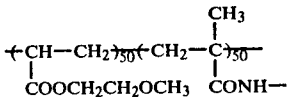 | 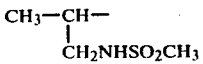 | The same as the above |
| M-18 | 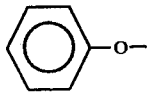 | 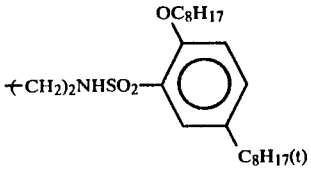 | The same as the above |
| M-19 | $CH_3$— | 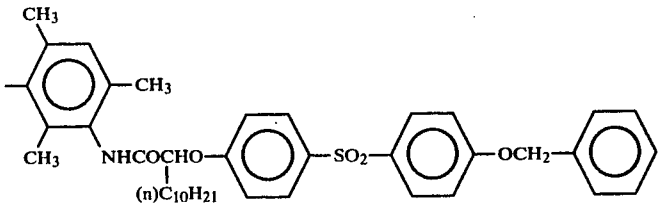 | The same as the above |
| M-20 | $(CH_3)_3C$— | 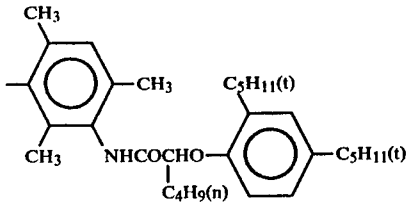 | The same as the above |

-continued
| | | | |
|---|---|---|---|
| M-21 | 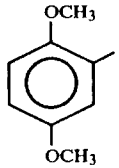 | 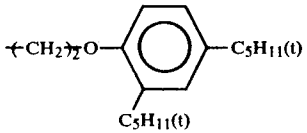 | The same as the above |
| M-22 | $CH_3-$ | $-CH(C_2H_5)-N(C_{18}H_{37}(n))COCH_2CH_2COOH$ | The same as the above |

The amount of the epoxy compounds of formulas (I) to (III) to be added is generally 0.001 to 10 g, preferably 0.01 to 5 g, and more preferably 0.03 to 1 g, per $m^2$. The amount of the compound of the coupler represented by formula (IV) or (M-II) to be added is generally 0.1 to 1.0 mol, preferably 0.1 to 5.0 mol, per mol of the silver halide to be contained in the silver halide emulsion layer constituting the photographic layer.

In the present invention, the magenta-coupler-containing green-sensitive silver halide emulsion layer preferably contains at least one magenta coupler represented by formula M-(II), and the ratio (A/B) of the weight (A) of the high-boiling organic solvent contained in said emulsion layer to the weight (B) of said magenta coupler is preferably 4.0 or over, more preferably as low as 4.0 but up to 6.0, and further more preferably as low as 4.5 but up to 5.5, in view of the light-fading.

In the present invention, the pH of the photographic component layer is not different from that of the prior art and is generally in the range of 4 to 9, but the present invention is not restricted to it.

As a silver halide to be used in the present invention, for example, silver chloride, silver bromide, silver bromo(iodo)chloride, and silver bromoiodide can be used, although preferably use is made of a silver chloride emulsion or silver bromochloride emulsion substantially free from silver iodide and having a silver chloride content of 90 mol % or more, more preferably 95 mol % or more, and particularly preferably 98% or more, for the purpose of rapid processing.

In the photographic material of the present invention, in order to improve, for example, the sharpness of an image, preferably a dye that can be processed to be decolored (in particular an oxonol dye), as described in European Patent EP 0,337,490A2, pages 27 to 76 is added to the hydrophilic colloid layer, or titanium oxide, whose surface has been treated with a dihydric to tetrahydric alcohol (e.g., trimethylolethane), is contained in an amount of 12% by weight or more (more preferably 14% by weight or more) in the water-resistant resin layer of the base.

In the photographic material of the present invention, a compound to improve the lasting quality of the image dye, as described in European Patent EP 0,277,589A2, is preferably used in combination with the coupler.

Combination with a pyrazoloazole coupler is particularly preferable.

That is, the use of a compound (F), which will chemically combine with the aromatic primary amine developing agent remaining after color development processing to produce a chemically inactive and substantially colorless compound, and/or a compound (G), which will chemically combine with the oxidized product of the aromatic primary amine developing agent remaining after color development processing to produce a chemically inactive and substantially colorless compound, is preferable because, for example, the occurrence of stain due to the production of a color formed dye by the reaction between the coupler and the color-developing agent remaining in the film or its oxidized product and other side effects related to storage after the processing can be prevented.

Preferable as compound (F) are those that can react with p-anisidine a the second-order reaction-specific rate $k_2$ (in trioctyl phosphate at 80° C.) in the range of 1.0 l/mol.sec to $1\times10^{-5}$ l/mol.sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_{21}-(A_1)_n-X_{21} \qquad \text{Formula (FI)}$$

$$R_{22}-\underset{\underset{B_1}{|}}{C}=Y_1 \qquad \text{Formula (FII)}$$

wherein $R_{21}$ and $R_{22}$ each represent an aliphatic group, an aromatic group, or a heterocyclic group, n is 1 or 0, $A_1$ represents a group that will react with an aromatic amine developing agent to form a chemical bond therewith, $X_{21}$ represents a group that will react with the aromatic amine developing agent and split off, $B_1$ represents a hydrogen atom, an aliphatic group, an aromatic group, a heterocyclic group, an acyl group, or a sulfonyl group, $Y_1$ represents a group that will facilitate the addition of the aromatic amine developing agent to the compound represented by formula (FII), and $R_{21}$ and $X_{21}$, or $Y_1$ and $R_{22}$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 283338/1987, European Published Patent Nos. 298,321 and 277,589.

On the other hand, more preferable examples of compound (G), which will chemically bond to the oxidized product of the aromatic amine developing agent remaining after color development processing, to form a chemically inactive and colorless compound, can be represented by the following formula (GI):

$$R_{23}-Z \qquad \text{Formula (GI)}$$

wherein $R_{23}$ represents an aliphatic group, an aromatic group, or a heterocyclic group, Z represents a nucleophilic group or a group that will decompose in the photographic material to release a nucleophilic group. Preferably the compounds represented by formula (GI) are ones wherein $^{n}CH_3I$ value (R. G. Pearson, et al., *J. Am. Cem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 29145/1987, Japanese Patent Application Nos. 136724/1988 and 214681/1987, and European Published Patent Nos. 298321 and 277589.

Details of combinations of compound (G) and compound (F) are described in European Published Patent No. 277589.

To the photographic material according to the present invention, a mildewproofing agent, as described in JP-A No. 271247/1988, is preferably added in order to prevent the growth of a variety of mildews and fungi that will propagate in the hydrophilic colloid layer and deteriorate the image.

The photographic material of the present invention may be exposed to visible light or infrared light. The method of exposure to light may be low-intensity exposure or high-intensity short-time exposure, and particularly in the latter case, a laser scan exposure system wherein the exposure time per picture element is less than $10^{-4}$ sec is preferable.

When exposure is carried out, the band stop filter described in U.S. Pat. No. 4,880,726 is preferably used. Thereby, light color mixing is eliminated and the color reproduction is remarkably improved.

The exposed photographic material may be subjected to conventional black-and-white development processing or color processing and, in the case of a color photographic material, preferably it is subjected to color development processing and then is bleached and fixed for the purpose of rapid processing. In particular, when the above-mentioned high-silver-chloride emulsion is used, the pH of the bleach-fix solution is preferably about 6.5 or below, more preferably about 6 or below, for the purpose of accelerating desilvering, etc.

With respect to silver halide emulsions, other materials (e.g., additives), and photographic component layers (e.g., layer arrangement) that will be applied to the photographic material of the present invention as well as processing methods and processing additives which will be applied to the photographic material of the present invention, particularly those described in below-mentioned patent publications, particularly in European Patent EP 0,355,660A2 (JP-A No. 107011/1989), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultra violet absorbent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent | p. 155 lower left column line 5 to p. 155 lower right | — | — |

-continued

| Element constituting photographic material | JP-A No. 215272/1987 | JP-A No. 33144/1990 | EP 0,355,660A2 |
|---|---|---|---|
| precursor | column line 2 | | |
| Compound releasing development restrainer | p. 155 lower right column lines 3 to 9 | — | — |
| Base | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 1 |
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note: In the cited part of JP-A No. 21572/1987, amendment filed on March 16, 1987 is included.

Further, as cyan couplers, diphenylimidazole cyan couplers described in JP-A No. 33144/1990, as well as 3-hydroxypyridine cyan couplers described in European Patent EP 0,333,185A2 (in particular one obtained by causing Coupler (42), which is a four-equivalent coupler, to have a chlorine coupling split-off group, thereby rendering it two-equivalent, and Couplers (6) and (9), which are listed as specific examples, are preferable) and cyclic active methylene cyan couplers described in JP-A No. 32260/1989 (in particular, specifically listed Coupler Examples 3, 8, and 34 are preferable) are preferably used.

As a method for color development processing of a photographic material using a high-silver-chloride emulsion, the method described in, for example, JP-A No. 207250/1990, page 27 (the left upper column) to page 34 (the right upper column), is preferably used.

The silver halide color photographic material of the present invention exhibits excellent effects in that the silver halide color photographic material has anti-fading properties on long-term storage and can form a dye image excellent in color reproduction. In particular, the silver halide color photographic material of the present invention is improved in anti-fading of yellow image with storage under high humidities and in preventing mixing of magenta into the yellow image, and it is excellent in color reproduction.

According to the present invention, a silver halide color photographic material that is excellent in rapid processability and good in color reproduction and tone reproduction, whose three colors, i.e., yellow, magenta, and cyan, are fast to irradiation with light approximately to the same extent, and whose red-color-formed part and yellow-color-formed part are prevented from being darkened by light-fading.

Next, the present invention will be described in detail in accordance with examples, but the invention is not limited to these examples.

EXAMPLE 1

Preparation of paper base

A wood pulp consisting of 70 parts of hard wood sulfate pulp and 30 parts of soft wood sulfate pulp was beaten by a disk refiner to 270 ml CSF and, 1.0 part of an alkylketene dimer (tradename: Aquapel 12, manufactured by DIC Hercules Co.) as a neutral sizing agent, 1.0 part of an anionic polyacrylamide (tradename: Polystron 194-7, manufactured by Arakawa Chemical Ind. Co.), 0.5 parts of a cationic polyacrylamide (tradename: Polystron 705, manufactured by Arakawa Chemical Ind. Co.), and 0.3 parts of polyamidopolyamineepichlorohydrin (trademane: Kymene 557, manufactured by DIC Hercules Co.), in bone dry weight ratio to the pulp, respectively, were added. Then the mixture was made into a raw paper having a basis weight of 170 g/m$^2$ and a thickness of 165 μm using a Fourdrinier paper machine, which paper was designated as Raw paper (A).

The pH value of Raw paper (A) was measured by the hot water extraction method of JIS P-8133 and was found to be 6.4.

To the same beaten pulp as that of Raw paper (A), 0.6 parts of an epoxidized fatty acid amide (trade-name: NS-715, manufactured by Kindai Kagaku Kogyo Co.) as a neutral sizing agent, 1.2 parts of an anionic polyacrylamide (tradename: Polystron 194-7, manufactured by Arakawa Chemical Ind. Co.), 1.0 part of aluminum sulfate, 0.9 parts of NaOH, and 1.0 part of cationic starch, in bone dry weight ratio to the pulp, respectively, were added.

Similarly to the Raw paper (A), the mixture was made into a Raw paper (B) having a basis weight having a basis weight of 170 g/m$^2$ and a thickness of 165 μm. The pH value of Raw paper (B) was found to be 7.3.

To the same beaten pulp as that of Raw paper (A), 1.0 g of sodium stearate, 1.0 part of an anionic polyacrylamide (tradename: Polystron 194-7, manufactured by Arakawa Chemical Ind. Co.), and 1.0 part of aluminum sulfate, in bone dry weight ratio to the pulp, respectively, were added. Then, similarly to the Raw paper (A), the mixture was made into a raw paper having a basis weight of 170 g/m$^2$ and a thickness of 165 μm, which was designated as Raw paper (C). The pH value thereof measured by the hot extraction method was 3.8.

Raw paper (D) was prepared in the same procedure as Raw paper (C), except that after the addition of aluminum sulfate, 0.5 parts of sodium aluminum was added. The pH value thereof measured by the hot water extraction method was 4.7.

The surface of each of Raw papers (A) to (D) on which a photosensitive material would be applied was coated a polyethylene film having a density of 0.94 g/m$^3$ and containing 10% by weight of titanium oxide by extrusion coating, so that the coating thickness might be 35 μm, and the under surface of each of them was coated a polyethylene film having a density of 0.98 g/m$^3$ by extrusion coating, so that the coating thickness might be 30 μm, thereby preparing Paper base (A) to (D).

After the surface of Paper base (A) prepared in the above manner was treated with corona discharge, a gelatin prime coat containing sodium dodecylbenzenesulfonate was applied on the surface, and further various photographic component layers were applied thereon, to prepare a multi-layer color photographic print paper 101 having the layer constitution having the layer constitution shown below. The coating solutions were prepared as follows.

Preparation of the first layer coating solution

To a mixture of 19.1 g of yellow coupler (ExY), 4.4 g of image-dye stabilizer (Cpd-1) and 0.7 g of image- dye stabilizer (Cpd-7), 27.2 ml of ethyl acetate and 8.2 g of solvent (Solv-3) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.70 μm of average grain size, and 0.08 and 0.10 of deviation coefficient of grain size distribution, respectively, each in which 0.2 mol % of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first layer coating solution. As a gelatin hardener for the respective layers, 1-oxy-3,5-dichloro-s-treazine sodium salt was used.

Cpd-10 and Cpd-11 were added in each layer so that the total amount might be 25.0 mg/m$^2$ and 50 g/m$^2$, respectively.

As spectral-sensitizing dyes for the respective layers, the following compounds were used:

Blue-sensitive emulsion layer:

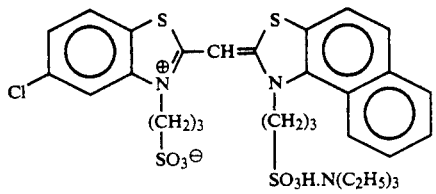

and

-continued

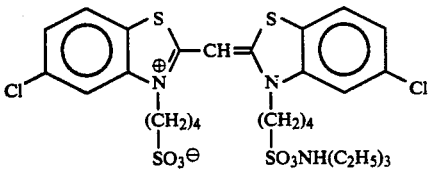

(each $2.0 \times 10^{-4}$ mol to the large size emulsion and $2.5 \times 10^{-4}$ mol to the small size emulsion, per mol of silver halide.)

Green-sensitive emulsion layer:

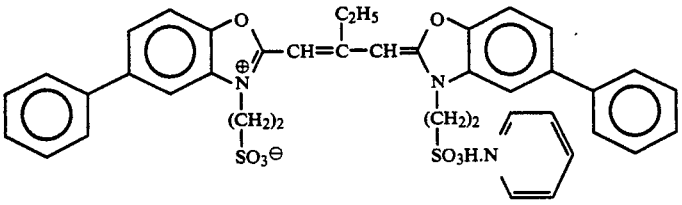

($4.0 \times 10^{-4}$ mol to the large size emulsion and $5.6 \times 10^{-4}$ mol to the small size emulsion, per mol of silver halide)

and

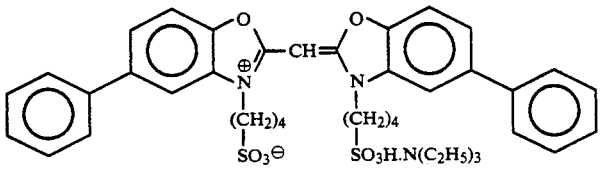

($7.0 \times 10^{-5}$ mol to the large size emulsion and $1.0 \times 10^{-5}$ mol to the small size emulsion, per mol of silver halide)

Red-sensitive emulsion layer:

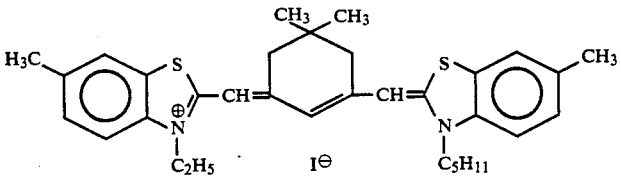

($0.9 \times 10^{-4}$ mol to the large size emulsion and $1.1 \times 10^{-4}$ mol to the small size emulsion, per mol of silver halide)

To the red-sensitive emulsion layer, the following compound was added in an amount of $2.6 \times 10^{-3}$ mol per mol of silver halide:

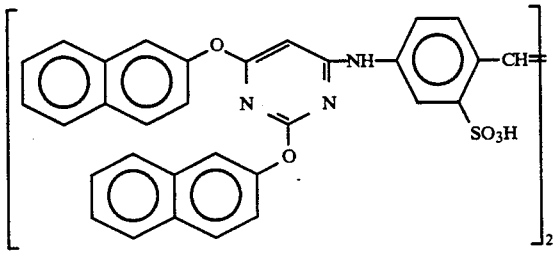

Further, 1-(5-methylureidophenyl)-5-mercaptotetrazole was added to the blue-sensitive emulsion layer, the green-sensitive emulsion layer, and the red-sensitive emulsion layer in amount of $8.5 \times 10^{-5}$ mol, $7.0 \times 10^{-4}$ mol, and $2.5 \times 10^{-4}$ mol, per mol of silver halide, respectively.

Further, 4-hydroxy-6-methyl-1,3,3a,7-tetrazaindene was added to the blue-sensitive emulsion layer and the green-sensitive layer in an amount of $1 \times 10^{-4}$ and $2 \times 10^{-4}$, per mol of silver halide, respectively.

The dyes shown below were added to the emulsion layers for prevention of irradiation.

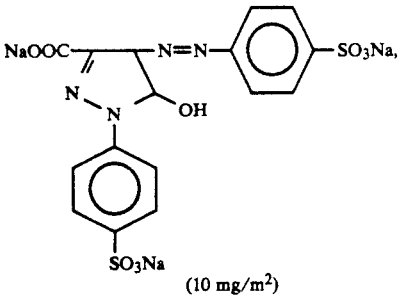

(10 mg/m²)

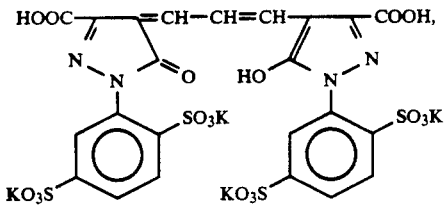

(10 mg/m²)

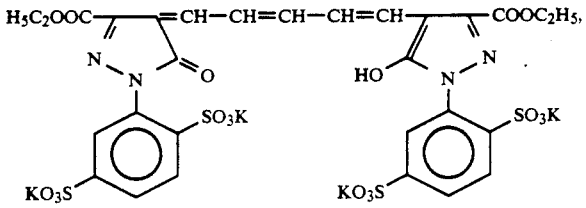

(40 mg/m²)

and

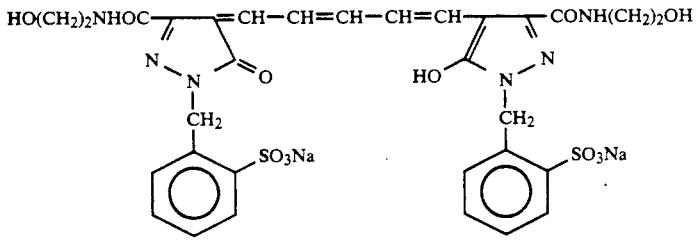

(20 mg/m²)

Composition of Layers

The composition of each layer is shown below. The figures represent coating amount (g/m²). The coating amount of each silver halide emulsion is given in terms of silver.

| | |
|---|---|
| Base Paper | |
| Paper laminated on both sides with polyethylene (a white pigment, $TiO_2$, and a bluish dye, ultramarine, were included in the first layer side of the polyethylene-laminated film) | |
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-3) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |

-continued

| | |
|---|---|
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |

-continued

| | |
|---|---|
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |

-continued

| | |
|---|---|
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compound used are as follows:

(ExY) Yellow coupler

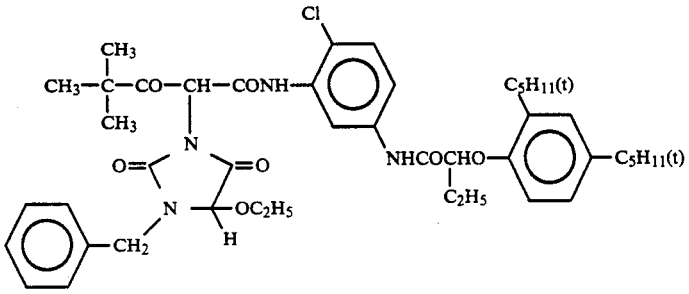

(ExM) Magenta coupler

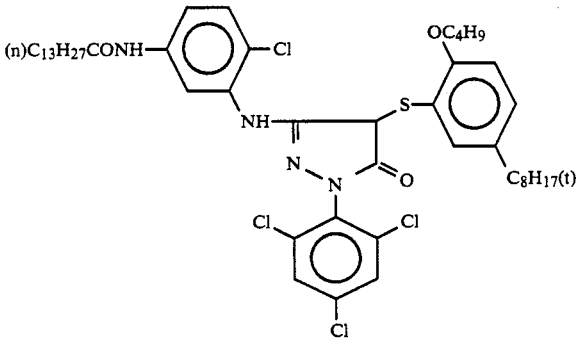

(ExC) Cyan coupler

Mixture ((a):(b):(c) = 2:4:4 in weight ratio) of (a) R = $C_2H_5$, (b) R = $C_4H_9$ of

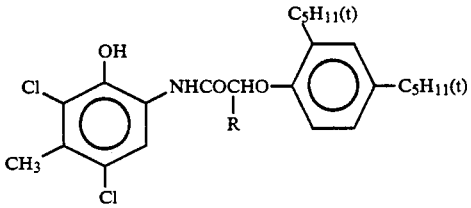

and

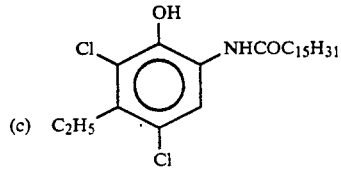

(Cpd-1) Image-dye stabilizer

-continued
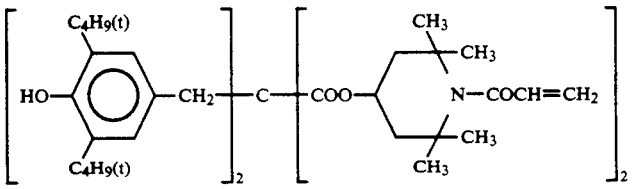
(Cpd-2) Image-dye stabilizer
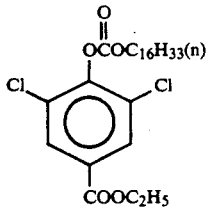
(Cpd-3) Image-dye stabilizer
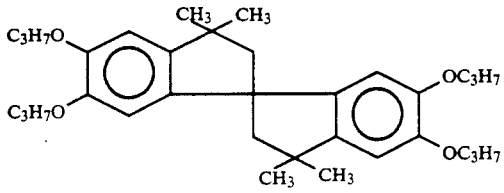
(Cpd-4) Image-dye stabilizer
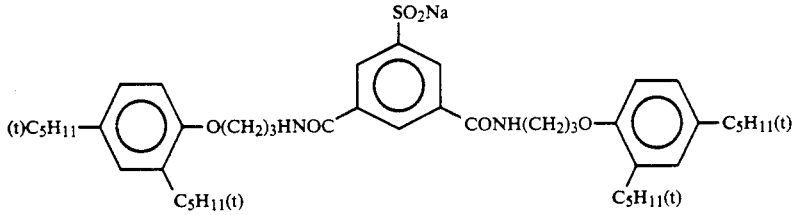
(Cpd-5) Color-mix inhibitor
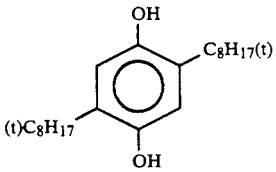
(Cpd-6) Image-dye stabilizer
Mixture (2:4:4 in weight ratio) of
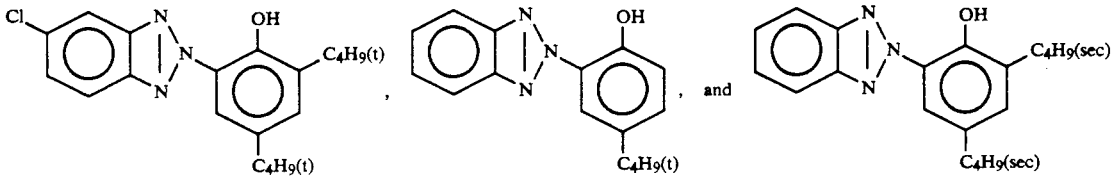
(Cpd-7) Image-dye stabilizer
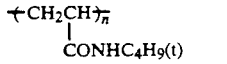
Average molecular weight: 60,000
(Cpd-8) Image-dye stabilizer -continued
Mixture (1:1 in weight ratio) of
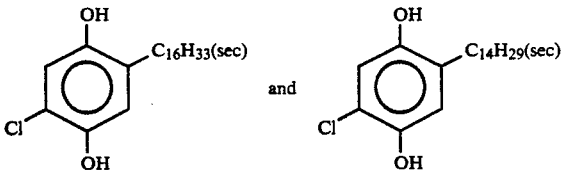
(Cpd-9) Image-dye stabilizer
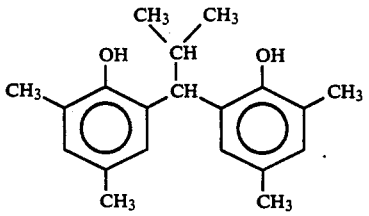
(Cpd-10) Antiseptics
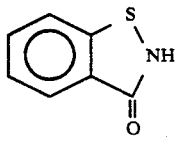
(Cpd-11) Antiseptics
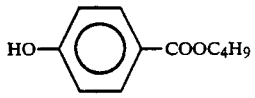
(UV-1) Ultraviolet ray absorber
Mixture (4:2:4 in volume ratio) of
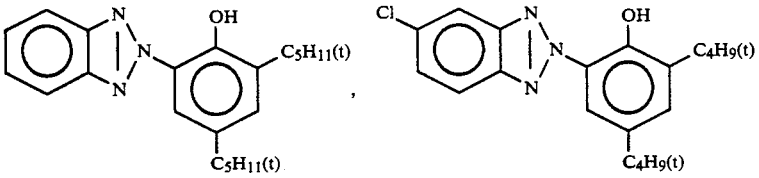
and
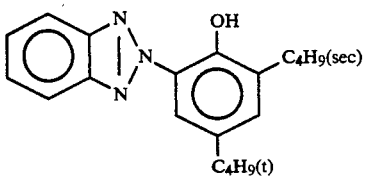
(Solv-1) Solvent
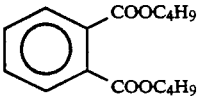
(Solv-2) Solvent
Mixture (2:1 in volume ratio) of -continued

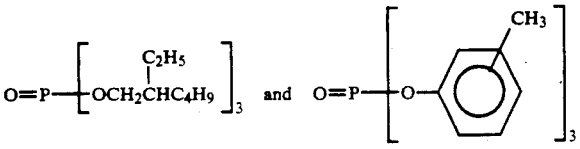

(Solv-3) Solvent $O{=}P{+}O{-}C_9H_{19}(iso)]_3$ (Solv-4) Solvent

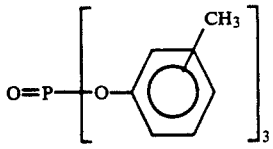

(Solv-5) Solvent $COOC_8H_{17}$
|
$(CH_2)_8$
|
$COOC_8H_{17}$ (Solv-6) Solvent

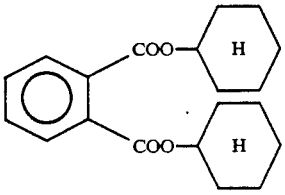

Color photographic print papers 102 to 130 were prepared in the same manner as color photographic print paper 101, except that, as shown in Table 1, an epoxy compound of the present invention was added in addition to Solv-3 as a solvent of the first layer (blue-sensitive emulsion layer) of the color photographic paper, and the paper base, the magenta coupler, and the yellow coupler were changed.

First, each of samples was subjected to a gradation exposure to three separated colors for sensitometry using a sensitometer (FMH Model manufactured by Fuji Photo Film Co., Ltd., the color temperature of light source was 3,200° K.). At that time, the exposure to light was carried out in such a manner that the exposure was 250 CMS with the exposure time being 0.1 sec.

After exposure to light, each sample was subjected to a continuous processing (running test) by the processing procedure shown below using a paper-processor, until a volume of color developer twice that of a tank had been replenished.

| Processing step | Temperature | Time | Replenisher* | Tank Volume |
|---|---|---|---|---|
| Color developing | 35° C. | 45 sec. | 161 ml | 17 liter |
| Bleach-fixing | 30–35° C. | 45 sec. | 215 ml | 17 liter |
| Rinse (1) | 30–35° C. | 20 sec. | — | 10 liter |
| Rinse (2) | 30–35° C. | 20 sec. | — | 10 liter |
| Rinse (3) | 30–35° C. | 20 sec. | 350 ml | 10 liter |

-continued

| Processing step | Temperature | Time | Replenisher* | Tank Volume |
|---|---|---|---|---|
| Drying | 70–80° C. | 60 sec. | | |

Note: *Replenisher amount: ml per $m^2$ of photographic material. (Rinse steps were carried out in three tanks counter-current flow system from the tank of rinse (3) towards the tank of rinse (1).)

The compositions of each processing solution were as follows:

| Color developer | Tank Solution | Replenisher |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfonate | 5.0 g | 7.0 g |
| N,N-Bis(carboxymethyl)hydrazine | 5.5 g | 7.0 g |
| Fluorescent brightening agent (WHITEX-4B, made by Sumitomo Chemical Ind. Co.) | 1.0 g | 2.0 g |
| Water to make | 1000 ml | 1000 ml |
| pH (25° C.) | 10.05 | 10.45 |

Bleach-fixing solution
(Both tank solution and replenisher)

| | |
|---|---|
| Water | 400 ml |
| Ammonium thiosulfate (70%) | 100 ml |
| Sodium sulfite | 17 g |
| Iron (III) ammonium ethylenediamine-tetraacetate dihydrate | 55 g |

-continued

| Color developer | Tank Solution | Replenisher |
|---|---|---|
| Disodium ethylenediaminetetraacetate | 5 g | |
| Ammonium bromide | 40 g | |
| Water to make | 1000 ml | |
| pH (25° C.) | 6.0 | |
| Rinse solution (Both tank solution and replenisher) Ion-exchanged water (Calcium and magnesium each are contained in an amount of 3 ppm or below) | | |

Color photographic print papers 102 to 130 were prepared in the same procedure as the color photographic print paper 101, except that, as shown in Table 1, in addition to solve-3 as a solvent of the first layer (blue-sensitive layer) of the color photographic print paper 101, an epoxy compound of the present invention was added, and the paper base, the magenta coupler, and the yellow coupler were changed.

With respect to the part exposed to light through a blue filter of each of the thus obtained samples (yellow), after it was stored for 6 months under conditions of a temperature of 60° C. and a relative humidity of 70%, the density drop $\Delta D^B$ from the blue filter initial density $D^B=2.0$ and the change $\Delta D^G$ of the green filter density (the amount of magenta mixed in the yellow) at $D^B=2.0$ were measured.

Further, the tone of the gray part from the negative film which took a photograph of a color checker (manufactured by Macbeth Co.) was adjusted and printed on each sample, and the color reproduction of each hue was evaluated organoleptically. As results, bright one was designated ○ and one apparently inferior to this was designated Δ.

TABLE 1

| Sample No. | Epoxy compound No. | Epoxy compound Coating amount (g/m²) | Base paper (Raw paper pH) | Yellow coupler | Magenta coupler | Image Keeping property $\Delta D^B$ | Image Keeping property $\Delta D^G$ | Coupler reproduction Yellow | Coupler reproduction Magenta | Coupler reproduction Red | Coupler reproduction Green | Remarks |
|---|---|---|---|---|---|---|---|---|---|---|---|---|
| 101 | — | — | A(6.4) | ExY | ExM | 0.19 | 0.20 | Δ | Δ | Δ | Δ | Comparative example |
| 102 | — | — | B(7.3) | ExY | ExM | 0.18 | 0.20 | Δ | Δ | Δ | Δ | Comparative example |
| 103 | — | — | C(3.8) | ExY | ExM | 0.30 | 0.21 | Δ | Δ | Δ | Δ | Comparative example |
| 104 | — | — | D(4.7) | ExY | ExM | 0.28 | 0.21 | Δ | Δ | Δ | Δ | Comparative example |
| 105 | Comparative compound A | 0.16 | D(4.7) | ExY | ExM | 0.23 | 0.21 | Δ | Δ | Δ | Δ | Comparative example |
| 106 | Comparative compound A | 0.16 | D(4.7) | ExY | M-15 | 0.23 | 0.41 | Δ | ○ | ○ | Δ | Comparative example |
| 107 | Comparative compound A | 0.16 | D(4.7) | Y-1 | M-15 | 0.29 | 0.46 | ○ | ○ | ○ | ○ | Comparative example |
| 108 | Comparative compound A | 0.16 | B(7.3) | Y-1 | M-15 | 0.24 | 0.43 | ○ | ○ | ○ | ○ | Comparative example |
| 109 | Comparative compound B | 0.16 | B(7.3) | Y-1 | M-15 | 0.25 | 0.43 | ○ | ○ | ○ | ○ | Comparative example |
| 110 | I-2 | 0.08 | B(7.3) | Y-1 | M-15 | 0.13 | 0.17 | ○ | ○ | ○ | ○ | This invention |
| 111 | I-5 | 0.08 | B(7.3) | Y-1 | M-15 | 0.15 | 0.20 | ○ | ○ | ○ | ○ | This invention |
| 112 | I-8 | 0.08 | B(7.3) | Y-1 | M-15 | 0.12 | 0.17 | ○ | ○ | ○ | ○ | This invention |
| 113 | I-9 | 0.08 | B(7.3) | Y-1 | M-15 | 0.13 | 0.17 | ○ | ○ | ○ | ○ | This invention |
| 114 | I-14 | 0.08 | B(7.3) | Y-1 | M-15 | 0.12 | 0.16 | ○ | ○ | ○ | ○ | This invention |
| 115 | I-2 | 0.16 | B(7.3) | Y-1 | M-15 | 0.10 | 0.13 | ○ | ○ | ○ | ○ | This invention |
| 116 | II-1 | 0.08 | B(7.3) | Y-1 | M-15 | 0.10 | 0.12 | ○ | ○ | ○ | ○ | This invention |
| 117 | II-2 | 0.08 | B(7.3) | Y-1 | M-15 | 0.10 | 0.12 | ○ | ○ | ○ | ○ | This invention |
| 118 | II-2 | 0.16 | B(7.3) | Y-1 | M-15 | 0.07 | 0.08 | ○ | ○ | ○ | ○ | This invention |
| 119 | III-1 | 0.08 | B(7.3) | Y-1 | M-15 | 0.13 | 0.17 | ○ | ○ | ○ | ○ | This invention |
| 120 | III-2 | 0.08 | B(7.3) | Y-1 | M-15 | 0.12 | 0.17 | ○ | ○ | ○ | ○ | This invention |
| 121 | II-2 | 0.08 | A(6.4) | Y-1 | M-15 | 0.10 | 0.12 | ○ | ○ | ○ | ○ | This invention |
| 122 | II-2 | 0.08 | A(6.4) | Y-2 | M-15 | 0.10 | 0.12 | ○ | ○ | ○ | ○ | This invention |
| 123 | II-2 | 0.08 | A(6.4) | Y-9 | M-9 | 0.11 | 0.12 | ○ | ○ | ○ | ○ | This invention |
| 124 | II-2 | 0.08 | A(6.4) | Y-12 | M-17 | 0.11 | 0.12 | ○ | ○ | ○ | ○ | This invention |
| 125 | I-2 | 0.08 | A(6.4) | Y-22 | M-28 | 0.13 | 0.17 | ○ | ○ | ○ | ○ | This invention |
| 126 | III-2 | 0.16 | B(7.3) | Y-2 | M-9 | 0.10 | 0.10 | ○ | ○ | ○ | ○ | This invention |
| 127 | II-3 | 0.16 | B(7.3) | Y-2 | M-9 | 0.07 | 0.08 | ○ | ○ | ○ | ○ | This invention |
| 128 | I-2 | 0.24 | B(7.3) | Y-2 | M-9 | 0.08 | 0.09 | ○ | ○ | ○ | ○ | This |

TABLE 1-continued

| Sample No. | Epoxy compound No. | Epoxy compound Coating amount ($g/m^2$) | Base paper (Raw paper pH) | Yellow coupler | Magenta coupler | Image Keeping property $\Delta D^B$ | Image Keeping property $\Delta D^G$ | Coupler reproduction Yellow | Coupler reproduction Magenta | Coupler reproduction Red | Coupler reproduction Green | Remarks |
|---|---|---|---|---|---|---|---|---|---|---|---|---|
| | | | | | | | | | | | | invention |
| 129 | III-3 | 0.08 | B(7.3) | Y-1 | M-15 | 0.12 | 0.17 | ○ | ○ | ○ | ○ | This invention |
| 130 | II-2 | 0.24 | B(7.3) | Y-1 | M-15 | 0.05 | 0.06 | ○ | ○ | ○ | ○ | This invention |
| 131 | I-2 | 0.08 | C(3.8) | Y-1 | M-15 | 0.19 | 0.20 | ○ | ○ | ○ | ○ | Comparative example |
| 132 | — | — | B(7.3) | Y-1 | M-15 | 0.21 | 0.40 | ○ | ○ | ○ | ○ | Comparative example |

Comparative compound A

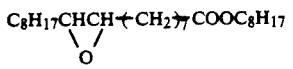

Comparative compound B

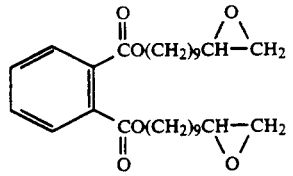

From the results shown in Table 1, it can be understood that samples of the present invention are excellent in color image preservability and color reproduction. That is, Sample 107 is more improved in color reproduction than Samples 101 to 106, but its color image preservability, including prevention of mixing of magenta into yellow and fading of yellow, is deteriorated, and although it can be improved a little by using a paper base whose raw paper has a pH value of 7.3, as in Samples 108 and 109, the improvement is not satisfactory. By contrast, Samples 110 to 130, wherein epoxy compounds of the present invention are additionally used, are made better in color image preservability and color reproduction.

EXAMPLE 2

After the surface of paper base was treated with corona discharge, a gelatin prime coat containing sodium dodecylbenzenesulfonate was applied on the surface, and further various photographic component layers were applied thereon, to prepare a multi-layer color photographic print paper (Sample 201) having the layer constitution shown below. The coating solutions were prepared as follows.

Preparation of the first layer coating solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate, 4.1 g of solvent (solv-3), and 4.1 g of solvent (Solv-7) were added and dissolved. The resulting solution was dispersed and emulsified in 185 ml of 10% aqueous gelatin solution containing 8 ml of sodium dodecylbenzenesulfonate to prepare emulsified dispersion A. Separately silver chlobromide emulsion A (cubic grains, 3:7 (silver mol ratio) blend of a large size emulsion A having 0.88 μm of average grain size and a small size emulsion A having 0.70 μm of average grain size, wherein the deviation coefficient of grain size distribution is 0.08 and 0.10, respectively, and each in which 0.2 mol % of silver bromide was located at the surface of grains) was prepared. In this emulsion, blue-sensitive sensitizing dyes A and B shown below were added in each amount of $2.0\times10^{-4}$ mol to the large size emulsion and $2.5\times10^{-4}$ mol to the small size emulsion, per mol of silver. Chemical ripening of this emulsion was conducted by addition of sulfur sensitizing agent and gold sensitizing agent. The above-described emulsified dispersion A and thus-prepared emulsion A were mixed together and dissolved to give the composition shown below, thereby preparing the first layer coating solution.

Coating solutions for the second to seventh layers were also prepared in the same manner as the first layer coating solution. As a gelatin hardener for the respective layers, 1-oxy-3,5-dichloro-s-treazine sodium salt was used.

Cpd-10 and Cpd-11 were added in each layer so that the total amount might be 25.0 $mg/m^2$ and 50 $g/m^2$, respectively.

As spectral-sensitizing dyes for silver chlorobromide emulsion in respective photosensitive emulsion layers, the following spectral sensitizing dyes were used:

Sensitizing dye A for blue-sensitive emulsion layer:

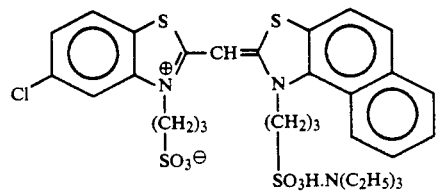

Sensitizing dye B for blue-sensitive emulsion layer:

-continued

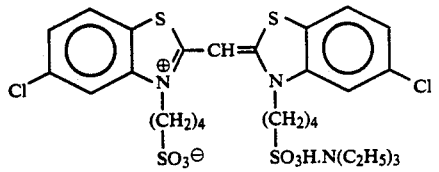

(each $2.0 \times 10^{-4}$ mol to the large size emulsion A and $2.5 \times 10^{-4}$ mol to the small size emulsion A, per mol of silver halide.)

Sensitizing dye C for green-sensitive emulsion layer:

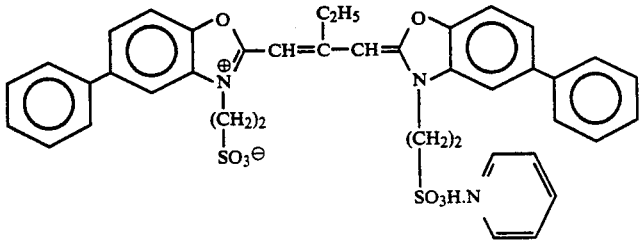

($4.0 \times 10^{-4}$ mol to the large size emulsion B and $5.6 \times 10^{-4}$ mol to the small size emulsion B, per mol of silver halide)

Sensitizing dye D for green-sensitive emulsion layer:

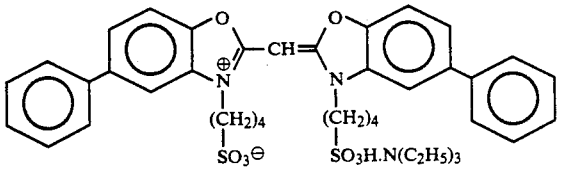

($7.0 \times 10^{-5}$ mol to the large size emulsion B and $1.0 \times 10^{-5}$ mol to the small size emulsion B, per mol of silver halide)

Sensitizing dye E for red-sensitive emulsion layer:

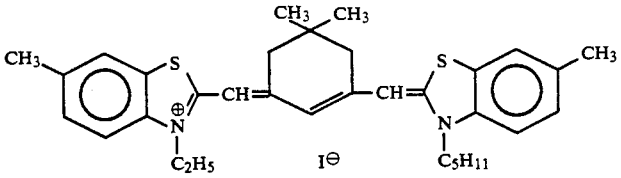

($0.9 \times 10^{-4}$ mol to the large size emulsion C and $1.1 \times 10^{-4}$ mol to the small size emulsion C, per mol of silver halide)

To the red-sensitive emulsion layer, the following compound was added in an amount of $2.6 \times 10^{-3}$ mol per mol of silver halide:

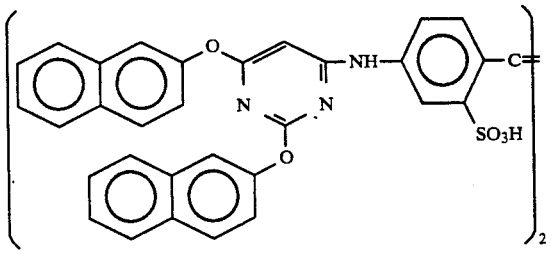

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.7\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive layer in an amount of $1\times10^{-4}$ and $2\times10^{-4}$, per mol of silver halide, respectively.

The dyes shown below (figure in parentheses indicates a coating amount) were added to the emulsion layers for prevention of irradiation.

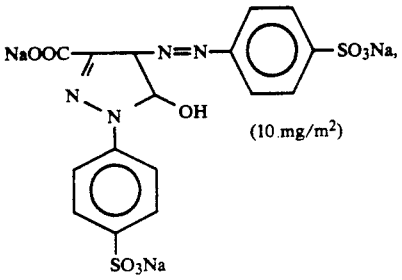

(10 mg/m²)

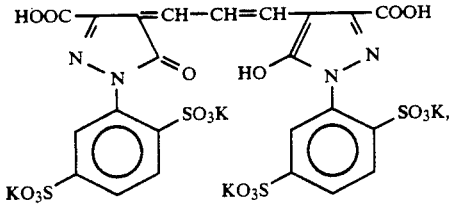

(10 mg/m²)

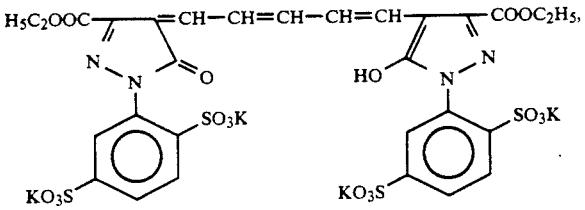

(40 mg/m²)

and

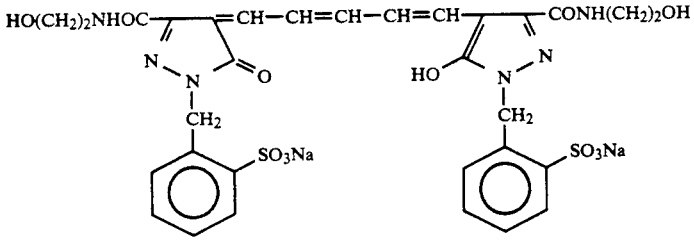

(20 mg/m²)

Composition of Layers

The composition of each layer is shown below. The figures represent coating amount (g/m²). The coating amount of each silver halide emulsion is given in terms of silver.

| | |
|---|---|
| Base Paper | |
| Paper laminated on both sides with polyethylene (a white pigment, $TiO_2$, and a bluish dye, ultramarine, were included in the first layer side of the polyethylene-laminated film) | |
| First Layer (Blue-sensitive emulsion layer): | |
| The above-described silver chlorobromide emulsion A | 0.30 |
| Gelatin | 1.86 |
| Yellow coupler (ExY) | 0.82 |
| Image-dye stabilizer (Cpd-1) | 0.19 |
| Solvent (Solv-3) | 0.18 |
| Solvent (Solv-7) | 0.18 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of a large size emulsion B having 0.55 μm of average grain | 0.12 |

-continued

| | |
|---|---|
| size and a small size emulsion B having 0.39 μm of average grain size, wherein the deviation coefficient of grain size distribution is 0.10 and 0.08, respectively, and each in which 0.8 mol % of AgBr was located at the surface of grains) | |
| Gelatin | 1.24 |
| Magenta coupler (ExM) | 0.23 |
| Image-dye stabilizer (Cpd-2) | 0.03 |
| Image-dye stabilizer (Cpd-3) | 0.16 |
| Image-dye stabilizer (Cpd-4) | 0.02 |
| Image-dye stabilizer (Cpd-9) | 0.02 |
| Solvent (Solv-2) | 0.69 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of a large size emulsion C having 0.58 μm of average grain size and a small size emulsion C having 0.45 μm of average grain size, wherein the | 0.23 |

-continued

| | |
|---|---|
| deviation coefficient of grain size distribution 0.09 and 0.111 on, respectively, and each in which 0.6 mol % of AgBr was located at the surface of grains) | |
| Gelatin | 1.34 |
| Cyan coupler (ExC) | 0.32 |
| Image-dye stabilizer (Cpd-2) | 0.03 |
| Image-dye stabilizer (Cpd-4) | 0.02 |
| Image-dye stabilizer (Cpd-6) | 0.18 |
| Image-dye stabilizer (Cpd-7) | 0.40 |
| Image-dye stabilizer (Cpd-8) | 0.05 |
| Solvent (Solv-6) | 0.14 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

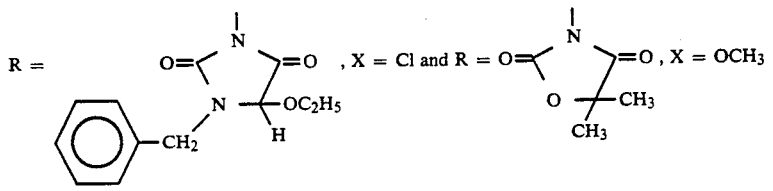

of the following formula

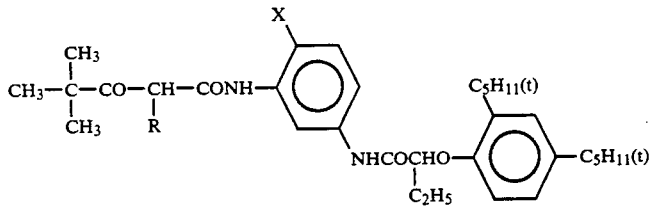

(ExM) Magenta coupler

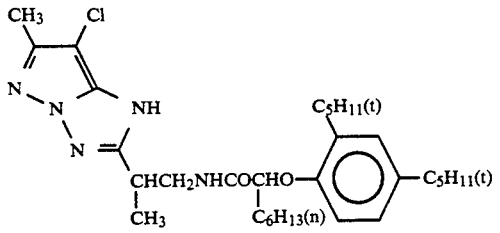

(ExC) Cyan coupler

Mixture (1:1 in molar ratio) of

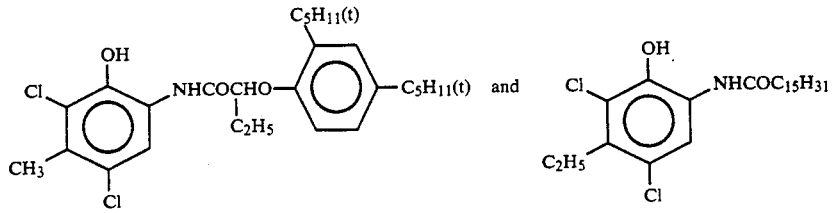

-continued
(Cpd-1) Image-dye stabilizer
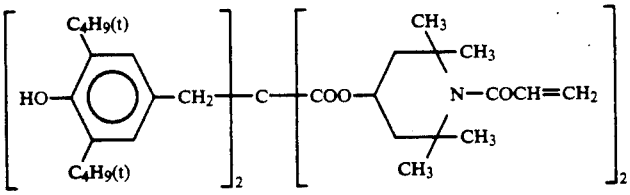
(Cpd-2) Image-dye stabilizer
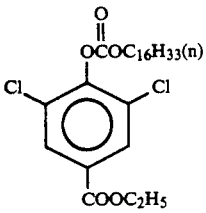
(Cpd-3) Image-dye stabilizer
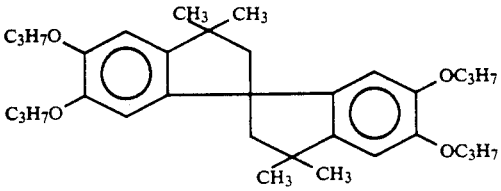
(Cpd-4) Image-dye stabilizer
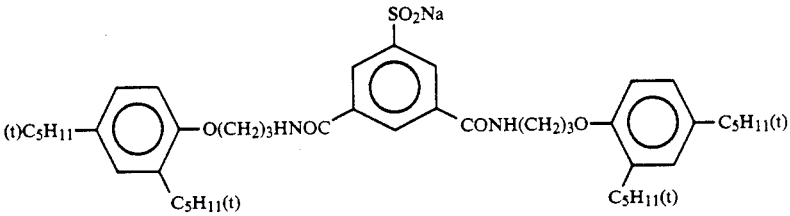
(Cpd-5) Color-mix inhibitor
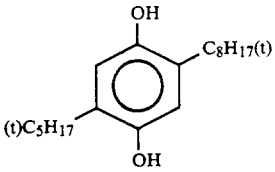
(Cpd-6) Image-dye stabilizer
Mixture (2:4:4 in weight ratio) of
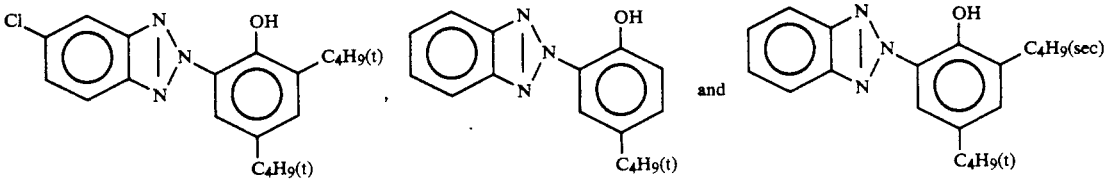
(Cpd-7) Image-dye stabilizer
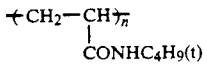
Average molecular weight: 60,000

-continued
(Cpd-8) Image-dye stabilizer
Mixture (1:1 in weight ratio) of
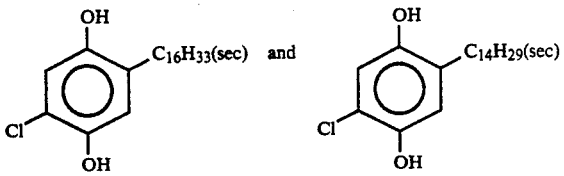
(Cpd-9) Image-dye stabilizer
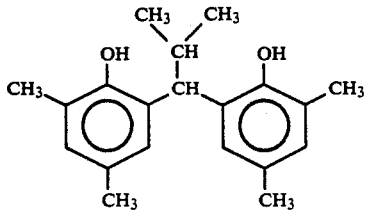
(Cpd-10) Antiseptics
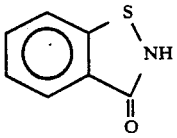
(Cpd-11) Antiseptics
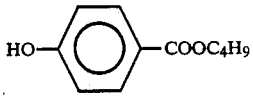
(UV-1) Ultraviolet ray absorber
Mixture (4:2:4 in weight ratio) of
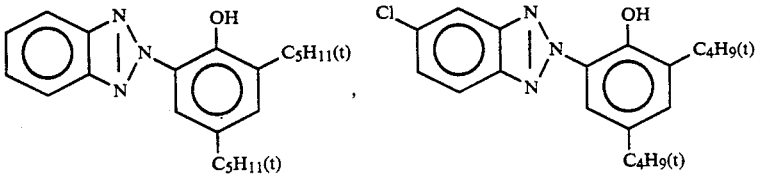
and
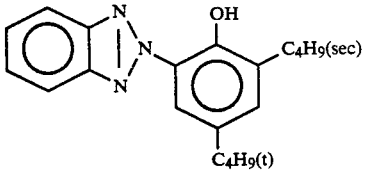
(Solv-1) Solvent
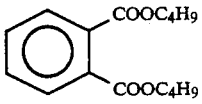
(Solv-2) Solvent
Mixture (1:1 in volume ratio) of -continued

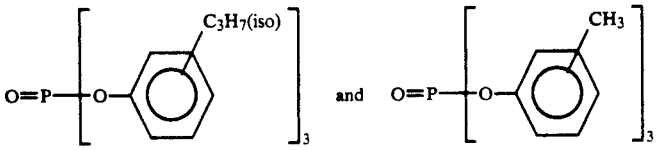

(Solv-3) Solvent $O{=}P{+}O{-}C_9H_{19}(iso)]_3$ (Solv-4) Solvent

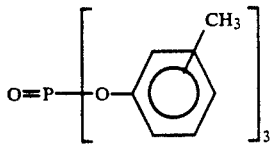

(Solv-5) Solvent $$\begin{array}{l} COOC_8H_{17} \\ | \\ (CH_2)_8 \\ | \\ COOC_8H_{17} \end{array}$$

(Solv-6) Solvent

Mixture (80:20 in volume ratio) of

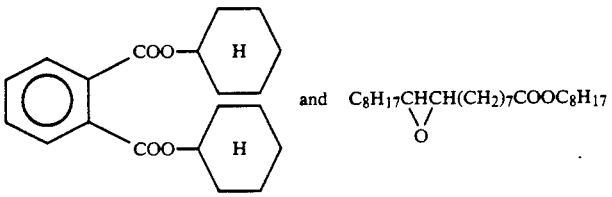

(Solv-7) Solvent $$C_8H_{17}\underset{\underset{O}{\backslash\,/}}{CHCH}(CH_2)_7COOC_8H_{17}$$

A color photographic paper was prepared in the same procedure as Sample 201, except that, instead of the large size emulsion C and the small size emulsion C which were used in the red-sensitive emulsion layer of Sample 201, emulsions prepared by adding, to the large size emulsion C and the small size emulsion C, Exemplified compound (V-36)in amounts of $2.5\times10^{-4}$ mol/mol Ag and $3.0\times10^{-4}$ mol/mol Ag, respectively, were used. This color photographic paper was designated Sample 202.

A color photographic paper was prepared in the same procedure as Sample 201, except that, instead of the large size emulsion C and the small size emulsion C which were used in the red-sensitive emulsion layer of Sample 201, emulsions prepared by adding, to the large size emulsion C and the small size emulsion C, Exemplified compound (V-41) in amounts of $1.5\times10^{-4}$ mol/mol Ag and $1.8\times10^{-4}$ mol/mol Ag respectively were used. This color photographic paper was designated Sample 203.

A color photographic paper was prepared in the same procedure as Sample 201, except that, instead of the large size emulsion C and the small size emulsion C which were used in the red-sensitive emulsion layer of Sample 201, a large size emulsion C' and a small size emulsion C' were used that were different from the said large size emulsion C and the said small size emulsion C in that the halogen composition was silver chlorobromide having a silver bromide content of 70%, and this color photographic paper was designated as Sample 204.

Color photographic paper Samples 205 to 208 were prepared in the same procedures as Samples 201 to 204, except that, as solvents in the blue-sensitive emulsion layer, Solv-3 and Solv-7 were used and epoxy compound (II-2) of the present invention was added in an amount of 0.18 g/m$^2$, respectively.

Color photographic paper samples 209 to 212 were prepared in the same procedures as Samples 205 to 208, except that Solv-2 in the green-sensitive emulsion layer was increased to 1.15 g/m$^2$.

Then, in order to investigate the color gradation reproduction at the red-color-formed parts of Samples 201 to 212, a coarsely knitted brilliant red garment (a wool sweater) was properly folded and was placed on a table, light was shone thereon from above at an angle, a photograph thereof was taken using Fuji Color Nega Super HG 100 film (tradename, manufactured by Fuji Photo Film Co., Ltd.), followed by subjecting to CN-16 development, indicated by Fuji Photo Film Co., Ltd., and printing was performed through this negative on each of the samples mentioned above using a Fuji 450 Printer. Each sample was then subjected to development processing shown below, thereby preparing color prints. The color reproduction and gradation of thus-prepared color prints were evaluated organoleptically. Specifically, regarding the brilliance of red and the stereoscopic sense of texture the following three grade evaluation was carried out.

Good: ○, Ordinary: Δ, Bad: x

| Processing step | Temperature | Time | Replenisher* | Tank Volume |
|---|---|---|---|---|
| Color developing | 35° C. | 45 sec. | 161 ml | 17 liter |
| Bleach-fixing | 30–35° C. | 45 sec. | 215 ml | 17 liter |
| Rinse (1) | 30–35° C. | 20 sec. | — | 10 liter |
| Rinse (2) | 30–35° C. | 20 sec. | — | 10 liter |
| Rinse (3) | 30–35° C. | 20 sec. | 350 ml | 10 liter |
| Drying | 70–80° C. | 60 sec. | | |

Note: *Replenisher amount: ml per $m^2$ of photographic material. (Rinse steps were carried out in three tanks counter-current flow system from the tank of rinse (3) towards the tank of rinse (1).)

The compositions of each processing solution were as follows:

| Color developer | Tank Solution | Replenisher |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfonate | 5.0 g | 7.0 g |
| N,N-Bis(carboxmethyl)hydrazine | 4.0 g | 5.0 g |
| Monosodium N,N-di(sulfoethyl)-hydroxylamine | 4.0 g | 5.0 g |
| Fluorescent brightening agent (WHITEX-4B, made by Sumitomo Chemical Ind. Co.) | 1.0 g | 2.0 g |
| Water to make | 1000 ml | 1000 ml |
| pH (25° C.) | 10.05 | 10.45 |
| Bleach-fixinq solution (Both tank solution and replenisher) | | |
| Water | 400 ml | |
| Ammonium thiosulfate (70%) | 100 ml | |
| Sodium sulfite | 17 g | |
| Iron (III) ammonium ethylenediaminetetraacetate dihydrate | 55 g | |
| Disodium ethylenediaminetetraacetate | 5 g | |
| Ammonium bromide | 40 g | |
| Wter to make | 1000 ml | |

-continued

| Color developer | Tank Solution | Replenisher |
|---|---|---|
| pH (25° C.) | 6.0 | |
| Rinse solution (Both tank solution and replenisher) Ion-exchanged water (Calcium and magnesium each are contained in an amount of 3 ppm or below) | | |

Each sample was given gradation light exposure for 0.1 sec through a cyan filter using a sensitometer (FWH-model, manufactured by Fuji Photo Film Co., Ltd.); the color temperature of the light source: 3200 K), was developed in the same way as described above, and the yellow density, the magenta density, and the cyan density were measured. According to this method, since a red color is formed from a low density to a high density and at the same time cyan color gradation appears at the high density part of part of the red, the degree of the color gradation reproduction can be simulated. The degree of the color gradation reproduction was quantified as the difference between the exposure amount that give 1.0 to the magenta density and the exposure amount that gave 1.0 to the cyan density.

In order to examine the degree of the light fading of the thus prepared color prints by sunlight, the color prints were allowed to stand outdoors for 12 weeks, and then the same organoleptic evaluation and density measurement as described above were made. The degree of the light fading with respect to yellow was quantitatively expressed as the reduction of the density of the exposure amount that gave 2.0 to the yellow density before the exposure to sunlight. With respect to magenta and cyan, the light fading was quantitatively expressed similarly. The results are shown in Table 2.

TABLE 2

| Sample No. | Practical print (Red sweater): Brightness of red, Before fading | Brightness of red, After fading | Three diamentional sense of texture, Before fading | Three diamentional sense of texture, after fading | Gradation exposure: Reproduction of color gradation, Before fading | Reproduction of color gradation, After fading | Decrement of density due to fading: Yellow | Magenta | Cyan | Remarks |
|---|---|---|---|---|---|---|---|---|---|---|
| 201 | ○ | Δ | X | X | 2.81 | 2.40 | 1.21 | 1.10 | 0.29 | Comparative example |
| 202 | ○ | X | ○ | ○ | 0.89 | 0.51 | 1.22 | 1.10 | 0.30 | Comparative example |
| 203 | ○ | X | ○ | ○ | 0.90 | 0.51 | 1.20 | 1.09 | 0.30 | Comparative example |
| 204 | ○ | X | ○ | ○ | 0.90 | 0.49 | 1.21 | 1.11 | 0.29 | Comparative example |
| 205 | ○ | ○ | X | X | 2.78 | 2.58 | 0.22 | 0.49 | 0.09 | Comparative example |
| 206 | ○ | Δ | ○ | ○ | 0.90 | 0.71 | 0.23 | 0.48 | 0.10 | This invention |
| 207 | ○ | Δ | ○ | ○ | 0.91 | 0.70 | 0.22 | 0.51 | 0.09 | This invention |
| 208 | ○ | Δ | ○ | ○ | 0.89 | 0.69 | 0.22 | 0.51 | 0.12 | Comparative example |
| 209 | ○ | ○ | X | X | 2.81 | 2.70 | 0.20 | 0.20 | 0.10 | Comparative example |
| 210 | ○ | ○ | ○ | ○ | 0.91 | 0.84 | 0.19 | 0.21 | 0.09 | This invention |
| 211 | ○ | ○ | ○ | ○ | 0.90 | 0.85 | 0.21 | 0.19 | 0.09 | This invention |
| 212 | ○ | ○ | ○ | ○ | 0.91 | 0.84 | 0.21 | 0.22 | 0.10 | Comparative example |

From Table 2, the following can be understood.

With respect to Samples 201 to 204, which do not use the epoxy compound of the present invention, the reduction of the density of the colors, particularly the reduction of the density of yellow and magenta, due to fading is great and the images become faint as a whole. Further, in Sample 201, although red is reproduced with the colorfulness being high, the three-dimensional sense of the interstices is poor and the shade is less visible. In Samples 202 to 204, although the three-dimensional sense of the interstices is expressed, the brightness of red is lost after fading and the red gives a blackish and dull sense.

In Samples 205 and 209, wherein although an epoxy compound of the present invention is used the silver halide emulsion of the cyan-coupler-containing silver halide emulsion layer is sensitized by inclusion of only a red-sensitive spectrally sensitizing dye, the reduction of the density of the colors due to fading is mitigated considerably but the three-dimensional feeling of the interstices is poor.

By contrast, in Samples 206 to 208, wherein an epoxy compound of the present invention is used and the silver halide emulsion of the cyan-coupler-containing silver halide emulsion layer is sensitized by inclusion of a red-sensitive spectrally sensitizing dye and a blue-sensitive spectrally sensitizing dye and/or a green-sensitive spectrally sensitizing dye, the red is expressed with the saturation being high, the three-dimensional sense o the interstices is felt, the shade is visible, and these merits are less lost after fading. In Samples 210 to 212, wherein a magenta coupler of the present invention is contained and the weight ratio of the high-boiling organic solvent to the magenta coupler satisfies the requirement of the present invention, there is little change after fading.

Thus, judging only from the standpoint of the color reproduction and the color gradation reproduction of the color prints and the change of the color balance during the storage of the images, it can be understood that Samples 206 to 208 are superior and Samples 210 to 212 are much superior.

On the other hand, it was confirmed that, of these Samples, Samples 208 and 212 which were comparative samples were high in silver bromochloride content, so that the developing speed was slow and when these Samples were subjected to running processing, bromide ions accumulated in the color developer, so that the developing speed became slow and the sensitivity successively lowered. In contrast, in Samples 206, 207, 210, and 211 of the present invention, these disadvantages were not observed. It can be understood that the Samples of the present invention are excellent collectively.

When, instead of Epoxy Compound (II-2) used in this Example, Exemplified Compound (I-2) or (III-2) was used, the same results as above were obtained.

Further, when, in the blue-sensitive spectrally sensitizing dye used for the spectrally sensitizing agent of the silver halide emulsion in the cyan-coupler-containing silver halide emulsion layer, instead of (V-36), the Exemplified Compound (V-34) was used, and in the green-sensitive spectrally sensitizing dye, instead of (V-41), Exemplified Compound (V-45) was used, the same results as above were obtained.

When, instead of magenta coupler (ExM), Exemplified Compound (M-13) was used, the same results as above were obtained.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide color photographic material which comprises in a hydrophilic colloid layer on a paper base at least one compound selected from the group consisting of sparingly water-soluble epoxy compounds represented by the following formula (I) wherein the pH of the raw paper of said paper base is between 5 and 9:

Formula (I)

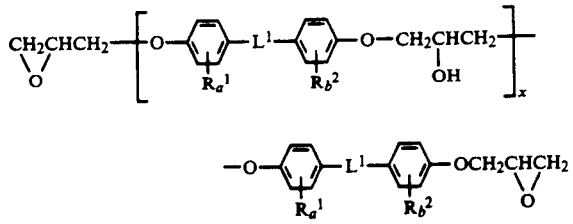

wherein $R^1$ and $R^2$ each represent an alkyl group or a halogen atom, each $L^1$ represents a bivalent aliphatic organic group, a and b each are an integer of 0 to 4, and x is a real number of 0 to 20.

2. The silver halide color photographic material as claimed in claim 1, wherein the silver halide color photographic material contains a yellow coupler represented by formula (IV):

Formula (IV)

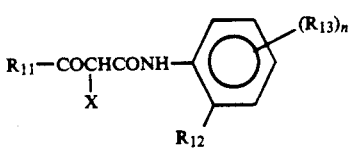

wherein $R_{11}$ represents an aryl group or a tertiary alkyl group, $R_{12}$ represents a fluorine atom, an alkyl group, an aryl group, an alkoxy group, an aryloxy group, a dialkylamino group, an alkylthio group, or an arylthio group, $R_{13}$ represents a group capable of substitution onto the benzene ring, X represents a hydrogen atom or a group capable of being released upon a coupling reaction with the oxidized product of an aromatic primary amine developing agent, n is an integer of 0 to 4, and when n is 2 or over, the groups $R_{13}$ may be the same or different.

3. The silver halide color photographic material as claimed in claim 1, wherein the silver halide color photographic material contains a magenta coupler represented by formula (M-II):

Formula (M-II)

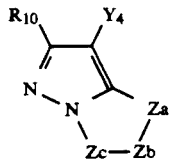

wherein formula (M-II), $R_{10}$ represents a hydrogen atom or a substituent; $Y_4$ represents a hydrogen atom or a coupling split-off group; Za, Zb, and Zc each represent methine, substituted methine, =N—, or —NH—; one of the Za—Zb bond and the Zb—Zc bond is a double bond and the other is a single bond; if the Zb—Zc bond is a carbon-carbon double bond it includes the case wherein it is part of the aromatic ring; a dimer or polymer may be formed through $R_{10}$ or $Y_4$, and when Za, Zb, or Zc represents substituted methine, a dimer or polymer may be formed through the substituted methine.

4. The silver halide color photographic material as claimed in claim 1, wherein the basis weight of raw paper is 20 to 300 g/m$^2$.

5. The silver halide color photographic material as claimed in claim 1, wherein the thickness of raw paper is 25 to 350 μm.

6. The silver halide color photographic material as claimed in claim 1, wherein the density of raw paper is 0.7 to 1.2 g/m$^3$.

7. A silver halide color photographic material having at least each of a yellow-coupler-containing blue-sensitive silver halide emulsion layer, a magenta-coupler-containing green-sensitive silver halide emulsion layer, and a cyan-coupler-containing red-sensitive silver halide emulsion layer on a base, which comprises in a cyan-coupler-containing photosensitive silver halide emulsion layer a silver halide emulsion having a silver chloride content of 90 mol % or more, said silver halide emulsion is sensitized by inclusion of a red-sensitive sensitizing dye, a blue-sensitive sensitizing dye and/or a green-sensitive sensitizing dye, and, in a hydrophilic colloid layer on a paper base, at least one compound selected from the group consisting of sparingly water-soluble epoxy compounds represented by the following formula (I)

10. The silver halide color photographic material as claimed in claim 7, wherein the silver halide emulsion contains 99.9 mol % or less of silver chloride.

11. The silver halide color photographic material as claimed in claim 7, wherein the red-sensitive sensitizing dye is selected from sensitizing dyes whose spectral sensitivity has a peak wavelength at 590 to 720 nm when it is absorbed to a silver chloride emulsion, the blue-sensitive sensitizing dye is selected from sensitizing dyes whose spectral sensitivity has a peak wavelength at 390 to 510 nm when it is absorbed to a silver chloride emulsion, and the green-sensitive sensitizing dye is selected from sensitizing dyes whose spectral sensitivity has a peak wavelength at 510 to 590 nm when it is absorbed to silver chloride emulsion.

12. The silver halide color photographic material as claimed in claim 7, wherein the amount of spectrally sensitizing dye to be added is $1\times10^{-6}$ mol to $1\times10^{-2}$ mol per mol of the silver halide.

13. The silver halide color photographic material as claimed in claim 1, wherein the epoxy compound represented by formula (I) has a solubility in water at 25° C.

Formula (I)

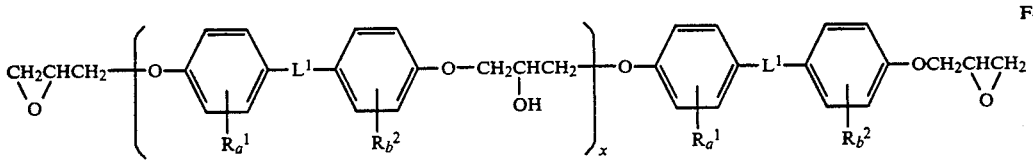

wherein $R^1$ and $R^2$ each represent an alkyl group or a halogen atom, each $L^1$ represents a bivalent aliphatic organic group, a and b each are an integer of 0 to 4, and x is a real number of 0 to 20.

8. The silver halide color photographic material as claimed in claim 7, wherein the silver halide color photographic material contains a magenta coupler represented by formula (M-II):

Formula (M-II)

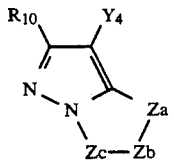

wherein formula (M-II), $R_{10}$ represents a hydrogen atom or a substituent; $Y_4$ represents a hydrogen atom or a coupling split-off group., Za, Zb, and Zc each represent methine, substituted methine, =N—, or —NH—; one of the Za—Zb bond and the Zb—Zc bond is a double bond and the other is a single bond; if the Zb—Zc bond is a carbon-carbon double bond it includes the case wherein it is part of the aromatic ring; a dimer or polymer may be formed through $R_{10}$ or $Y_4$, and when Za, Zb, or Zc represents substituted methine, a dimer or polymer may be formed through the substituted methine.

9. The silver halide color photographic material as claimed in claim 8, wherein the magenta-coupler-containing green-sensitive silver halides emulsion layer contains at least one magenta coupler represented by formula (M-II), and the ratio (A/B) of the weight (A) of the high-boiling organic solvent contained in said emulsion layer to the weight (B) of said magenta coupler is 4.0 or over.

of 10% or below.

14. The silver halide color photographic material as claimed in claim 7, wherein the epoxy compound represented by formula (I) has a solubility in water at 25° C. of 10% or below.

15. The silver halide color photographic material as claimed in claim 1, wherein the epoxy compound represented by formula (I) is added 0.001 g to 10 g per square meter of the silver halide color photographic material.

16. The silver halide color photographic material as claimed in claim 7, wherein the epoxy compound represented by formula (I) is added 0.001 g to 10 g per square meter of the silver halide color photographic material.

17. The silver halide color photographic material as claimed in claim 1, wherein the pH of the raw paper of paper base is 5.5 to 8.5.

18. The silver halide color photographic material which comprises in a hydrophilic colloid layer on a paper base at least one compound selected from the group consisting of sparingly water-soluble epoxy compounds represented by the following formula (II), wherein the pH of the raw paper of said paper base is between 5 and 9:

Formula (II)

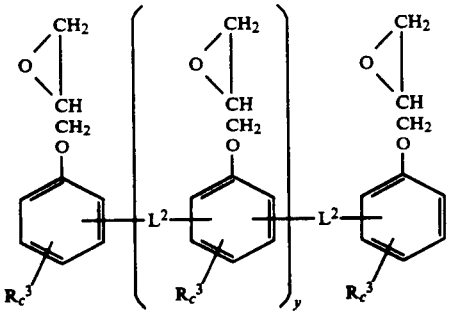

wherein each $R^3$ represents an alkyl group or a halogen atom, each $L^2$ represents a bivalent aliphatic organic group, each c is an integer of 0 to 4, and y is a real number of 0 to 20.

19. The silver halide color photographic material as claimed in claim 18, wherein the silver halide color photographic material contains a yellow coupler represented by formula (IV):

Formula (IV)

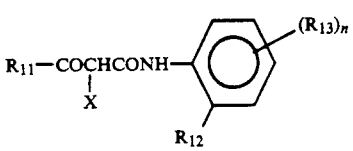

wherein $R_{11}$ represents an aryl group or a tertiary alkyl group, $R_{12}$ represents a fluorine atom, an alkyl group, an aryl group, an alkoxy group, an aryloxy group, a dialkylamino group, an alkylthio group, or an arylthio group, $R_{13}$ represents a group capable of substitution onto the benzene ring, X represents a hydrogen atom or a group capable of being released upon a coupling reaction with the oxidized product of an aromatic primary amine developing agent, n is an integer of 0 to 4, and when n is 2 or over, the groups $R_{13}$ may be the same or different.

20. The silver halide color photographic material as claimed in claim 18, wherein the silver halide color photographic material contains a magenta coupler represented by formula (M-II):

Formula (M-II)

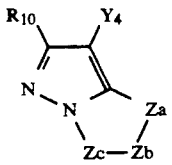

wherein formula (M-II), $R_{10}$ represents a hydrogen atom or a substituent; $Y_4$ represents a hydrogen atom or a coupling split-off group; Za, Zb, and Zc each represent methine, substituted methine, =N—, or —NH—; one of the Za—Zb bond and the Zb—Zc bond is a double bond and the other is a single bond; if the Zb—Zc bond is a carbon-carbon double bond it includes the case wherein it is part of the aromatic ring; a dimer or polymer may be formed through $R_{10}$ or $Y_4$, and when Za, Zb, or Zc represents substituted methine, or dimer or polymer may be formed through the substituted methine.

21. The silver halide color photographic material as claimed in claim 18, wherein the basis weight of raw paper is 20 to 300 g/m$^2$.

22. The silver halide color photographic material as claimed in claim 18, wherein the thickness of raw paper is 25 to 350 μm.

23. The silver halide color photographic material as claimed in claim 18, wherein the density of raw paper is 0.7 to 1.2 g/m$^3$.

24. The silver halide color photographic material having at least each of a yellow-coupler-containing blue-sensitive silver halide emulsion layer, a magenta-coupler-containing green-sensitive silver halide emulsion layer, and a cyan-coupler-containing red-sensitive silver halide emulsion layer on a base, which comprises in a cyan-coupler-containing photosensitive silver halide emulsion layer a silver halide emulsion having a silver chloride content of 90 mol % or more, said silver halide emulsion is sensitized by inclusion of a red-sensitive sensitizing dye, a blue-sensitive sensitizing dye and/or a green-sensitive sensitizing dye, and, in a hydrophilic colloid layer on a paper base, at least one compound selected from the group consisting of sparingly water-soluble epoxy compounds represented by the following formula (II)

Formula (II)

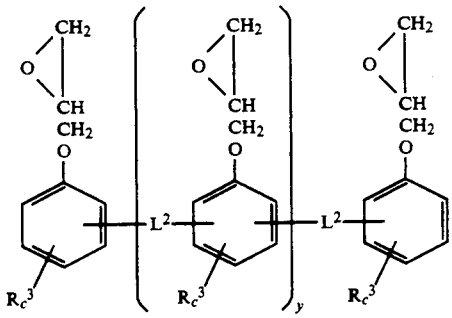

wherein each $R^3$ represents an alkyl group or a halogen atom, each $L^2$ represents a bivalent aliphatic organic group, each c is an integer of 0 to 4, and y is a real number of 0 to 20.

25. The silver halide color photographic material as claimed in claim 24, wherein the silver halide color photographic material contains a magenta coupler represented by formula (M-II):

Formula (M-II)

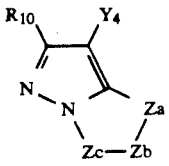

wherein formula (M-II), $R_{10}$ represents a hydrogen atom or a substituent; $Y_4$ represents a hydrogen atom or a coupling split-off group; Za, Zb, and Zc each represent methine, substituted methine, =N—, or —NH—; one of the Za—Zb bond and the Zb—Zc bond is a double bond and the other is a single bond; if the Zb—Zc bond is a carbon-carbon double bond it includes the case wherein it is part of the aromatic ring; a dimer or polymer may be formed through $R_{10}$ or $Y_4$, and when Za, Zb, or Zc represents substituted methine, a dimer or polymer may be formed through the substituted methine.

26. The silver halide color photographic material as claimed in claim 25, wherein the magenta-coupler-containing green-sensitive silver halide emulsion layer contains at least one magenta coupler represented by formula (M-II), and the ratio (A/B) of the weight (A) of the high-boiling organic solvent contained in said emulsion layer to the weight (B) of said magenta coupler is 4.0 or over.

27. The silver halide color photographic material as claimed in claim 24, wherein the silver halide emulsion contains 99.9 mol % or less of silver chloride.

28. The silver halide color photographic material as claimed in claim 24, wherein the red-sensitive sensitizing dye is selected from sensitizing dyes whose spectral sensitivity has a peak wavelength at 590 to 720 nm when it is absorbed to a silver chloride emulsion, the blue-sensitive sensitizing dye is selected from sensitizing dyes whose spectral sensitivity has a peak wavelength at 390 to 510 nm when it is absorbed to a silver chloride emulsion, and the green-sensitive sensitizing dye is selected from sensitizing dyes whose spectral sensitivity has a peak wavelength at 510 to 590 nm when it is absorbed to silver chloride emulsion.

29. The silver halide color photographic material as claimed in claim 24, wherein the amount of spectrally sensitizing dye to be added is $1\times10^{-6}$ mol to $1\times10^{-2}$ mol per mol of the silver halide.

30. The silver halide color photographic material as claimed in claim 18, wherein the epoxy compound represented by formula (II) has a solubility in water at 25° C. of 10% or below.

31. The silver halide color photographic material as claimed in claim 24, wherein the epoxy compound represented by formula (II) has a solubility in water at 25° C. or 10% or below.

32. The silver halide color photographic material as claimed in claim 18, wherein the epoxy compound represented by formula (II) is added 0.001 g to 10 g per square meter of the silver halide color photographic material.

33. The silver halide color photographic material as claimed in claim 24, wherein the epoxy compound represented by formula (II) is added 0.001 g to 10 g per square meter of the silver halide color photographic material.

34. The silver halide color photographic material as claimed in claim 18, wherein the pH of the raw paper of said paper base is 5.5 to 8.5.

* * * * *